US008203500B2

(12) United States Patent
Honda et al.

(10) Patent No.: US 8,203,500 B2
(45) Date of Patent: Jun. 19, 2012

(54) COMPACT CIRCULARLY POLARIZED OMNI-DIRECTIONAL ANTENNA

(75) Inventors: Royden M. Honda, Post Falls, ID (US); Robert J. Conley, Liberty Lake, WA (US)

(73) Assignee: LHC2 Inc, Liberty Lake, WA (US)

( * ) Notice: Subject to any disclaimer, the term of this patent is extended or adjusted under 35 U.S.C. 154(b) by 336 days.

(21) Appl. No.: 12/692,556

(22) Filed: Jan. 22, 2010

(65) Prior Publication Data

US 2010/0188308 A1 Jul. 29, 2010

Related U.S. Application Data

(60) Provisional application No. 61/147,058, filed on Jan. 23, 2009.

(51) Int. Cl.
*H01Q 21/08* (2006.01)

(52) U.S. Cl. ..... 343/824; 343/853; 343/895

(58) Field of Classification Search ..... 343/700 MS, 343/824, 850, 853, 857, 858, 895
See application file for complete search history.

(56) References Cited

U.S. PATENT DOCUMENTS

| | | | | |
|---|---|---|---|---|
| 2,625,654 | A | | 1/1953 | Alford |
| 2,812,514 | A | | 11/1957 | Smith |
| 3,474,452 | A | | 10/1969 | Bogner |
| 3,555,552 | A | | 1/1971 | Alford |
| 3,618,114 | A | | 11/1971 | Dietrich |
| 3,665,479 | A | | 5/1972 | Silliman |
| 3,810,183 | A | | 5/1974 | Krutsinger et al. |
| 4,131,892 | A | | 12/1978 | Munson et al. |
| 4,204,212 | A | | 5/1980 | Sindoris et al. |
| 4,233,607 | A | | 11/1980 | Sanford et al. |
| 4,451,829 | A | | 5/1984 | Stuckey, Jr. et al. |
| 4,527,163 | A | | 7/1985 | Stanton |
| 4,546,459 | A | * | 10/1985 | Congdon ..... 367/155 |
| 4,613,868 | A | | 9/1986 | Weiss |
| 4,710,775 | A | | 12/1987 | Coe |
| 4,839,663 | A | | 6/1989 | Kurtz |
| 4,899,165 | A | | 2/1990 | Schadler |
| 4,907,008 | A | | 3/1990 | Dienes |
| 5,021,797 | A | | 6/1991 | Dienes |

(Continued)

FOREIGN PATENT DOCUMENTS

EP 1959518 A2 8/2008

(Continued)

OTHER PUBLICATIONS

Brown, et al., "Circularly-Polarized Omnidirectional Antenna" RCA Review, pp. 259-269, Jun. 1947.

(Continued)

*Primary Examiner* — Hoanganh Le
(74) *Attorney, Agent, or Firm* — Lee & Hayes, PLLC

(57) ABSTRACT

Antennas that can transceive signals in an elliptically-polarized, omni-directional manner are described. In an example embodiment, an antenna comprises two elements proximally located to each other at a predetermined distance, such that two orthogonally-polarized omni-directional electromagnetic waves are tranceived. In a further example, the two elements are supported by an internal printed circuit, the printed circuit including conductors configured to supply a feed to the elements, which may be contained within a radome. Alternate embodiments comprise a plurality of elements of varying lengths.

19 Claims, 22 Drawing Sheets

U.S. PATENT DOCUMENTS

| | | | | |
|---|---|---|---|---|
| 5,105,199 | A | 4/1992 | Ukmar | |
| 5,426,439 | A | 6/1995 | Grossman | |
| 5,617,105 | A | 4/1997 | Tsunekawa et al. | |
| 5,870,061 | A | 2/1999 | Casciola et al. | |
| 5,955,997 | A | 9/1999 | Ho et al. | |
| 6,127,983 | A | 10/2000 | Rivera et al. | |
| 6,313,806 | B1 | 11/2001 | Schadler | |
| 6,414,647 | B1 | 7/2002 | Lee | |
| 6,567,053 | B1 | 5/2003 | Yablonovitch et al. | |
| 6,593,892 | B2 | 7/2003 | Honda et al. | |
| 6,897,822 | B2 | 5/2005 | Sparks et al. | |
| 6,967,625 | B1 | 11/2005 | Honda | |
| 6,995,725 | B1 | 2/2006 | Honda et al. | |
| 7,256,750 | B1 | 8/2007 | Honda | |
| 7,394,435 | B1 | 7/2008 | Tavassoli Hozouri | |
| 2005/0012673 | A1 | 1/2005 | Parsche et al. | |
| 2010/0090924 | A1 * | 4/2010 | Honda et al. | 343/872 |
| 2010/0289716 | A1 * | 11/2010 | Lenzi et al. | 343/793 |

FOREIGN PATENT DOCUMENTS

| | | | |
|---|---|---|---|
| JP | 2001352210 | A | 12/2001 |
| WO | WO0249147 | A2 | 6/2002 |
| WO | WO02065583 | A1 | 8/2002 |

OTHER PUBLICATIONS

Carver, et al., "Microstrip Antenna Technology", IEEE Transactions on Antennas and Propagation, vol. AP-29, No. 1, 23 pages, Jan. 1981.

DeJean, Design of Compact Antennas in Multilayer Technology for Wireless Communications / WLAN Applications, A Thesis Presented to the Academic Faculty, Georgia Institute of Technology, 83 pages, Dec. 2, 2004.

Krall, et al., "The Omni Microstrip Antenna: A new Small Antenna", IEEE Transactions on Antennas and Propagation, vol. AP-27, No. 6, 4 pages, Nov. 1979.

Munson, "Conformal Microstrip Antennas and Microstrip Phased Arrays", IEEE Transactions on Antennas and Propagation, 5 pages, Jan. 1974.

Carver, et al., "Microstrip Antenna Technology", IEEE Transactions on Antennas and Propagation, vol. AP-29, No. 1, Jan. 1981.

DeJean, Design of Compact Antennas in Multilayer Technology for Wireless Communications / WLAN Applications, A Thesis Presented to the Academic Faculty, Georgia Institute of Technology, Dec. 2, 2004.

* cited by examiner

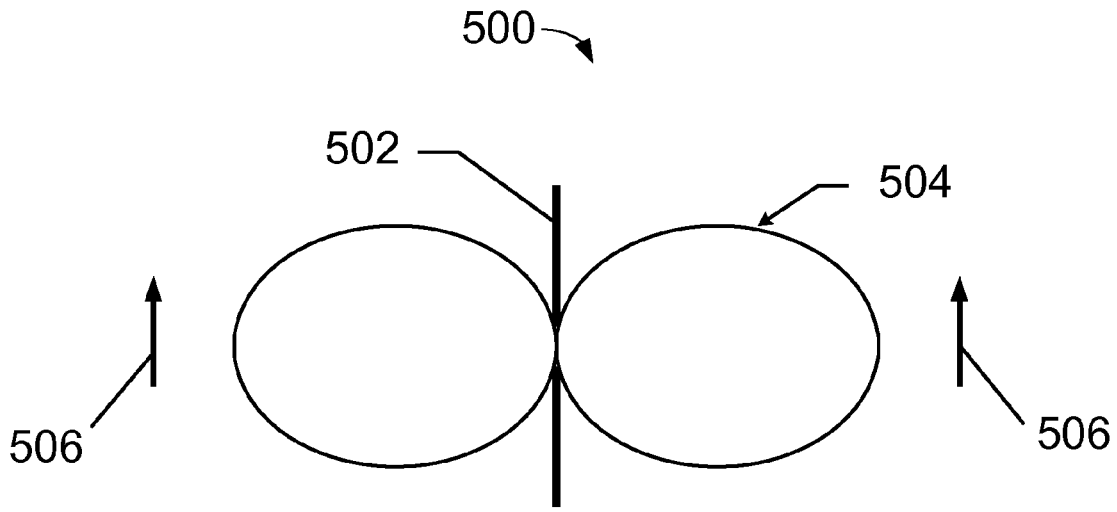
Fig. 5A
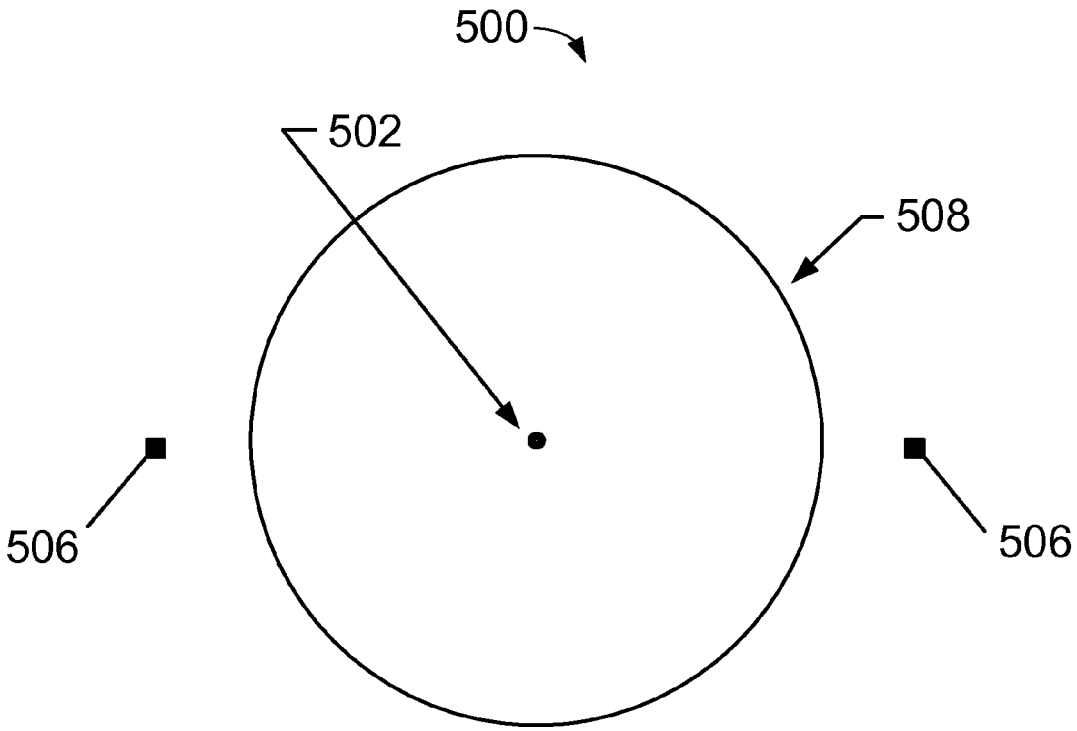
Fig. 5B
FIG. 5

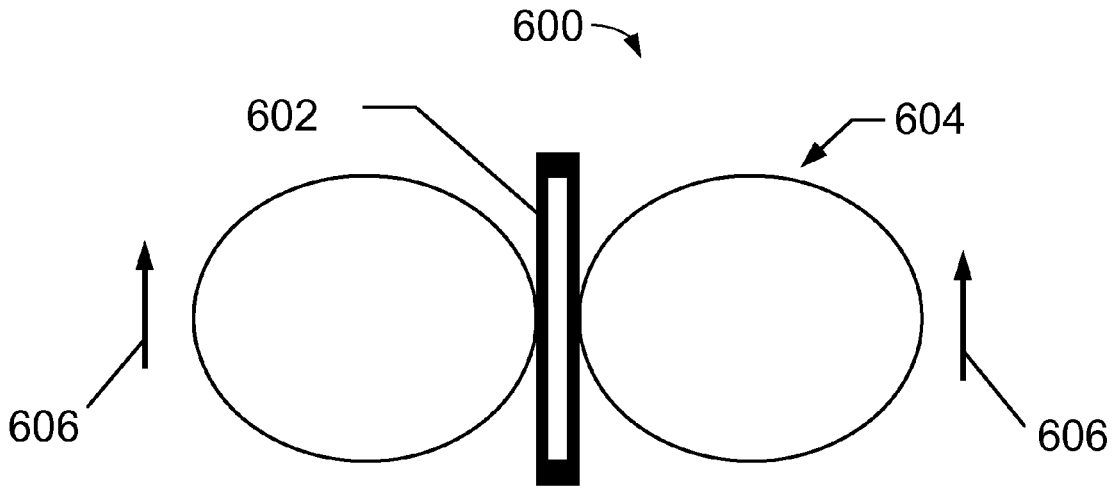
Fig. 6A
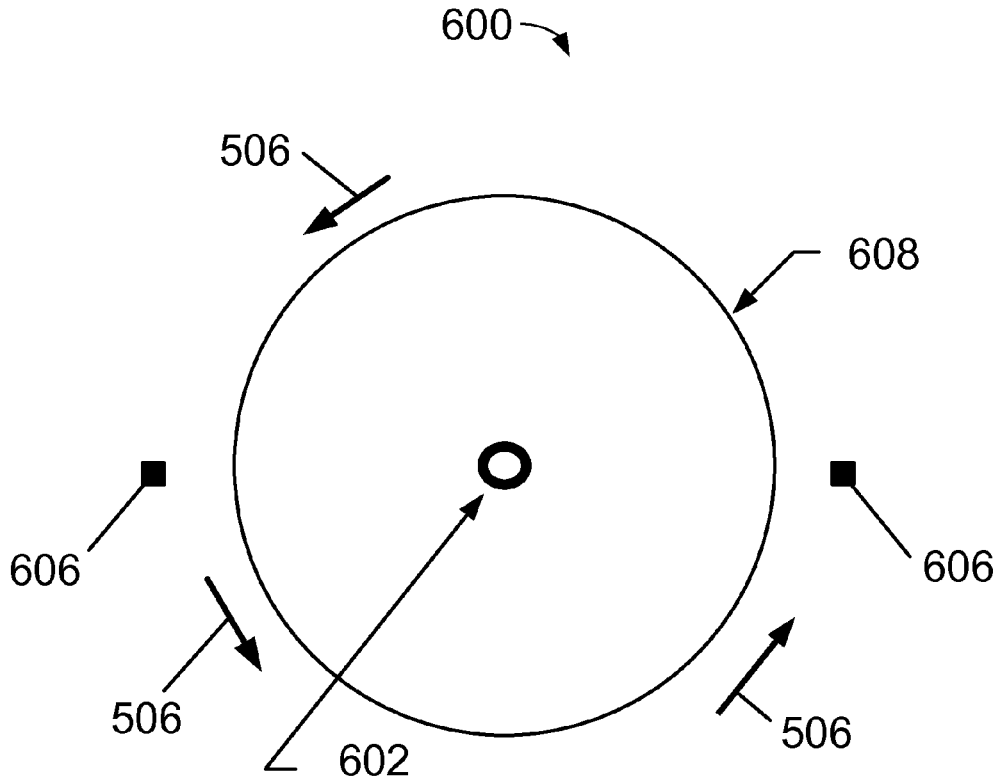
Fig. 6B
FIG. 6

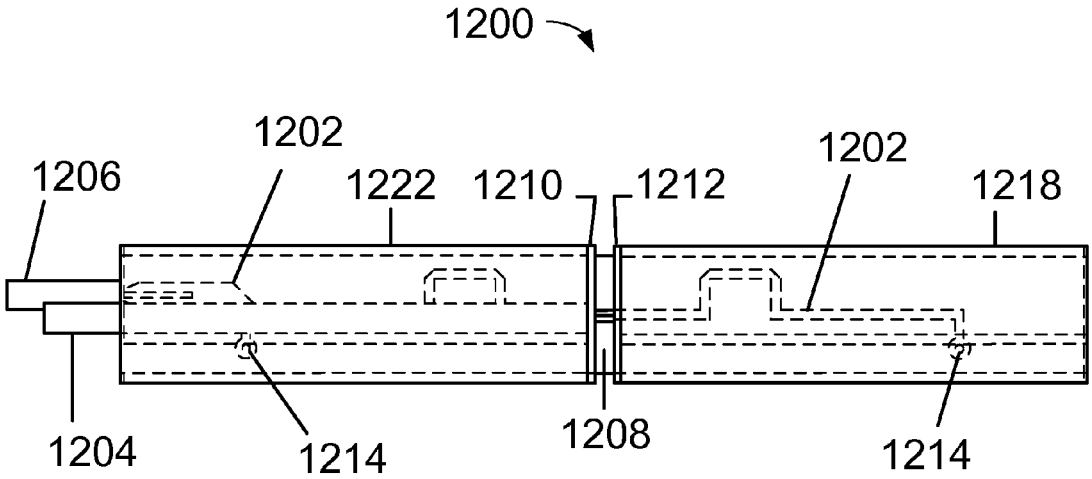
Fig. 12A
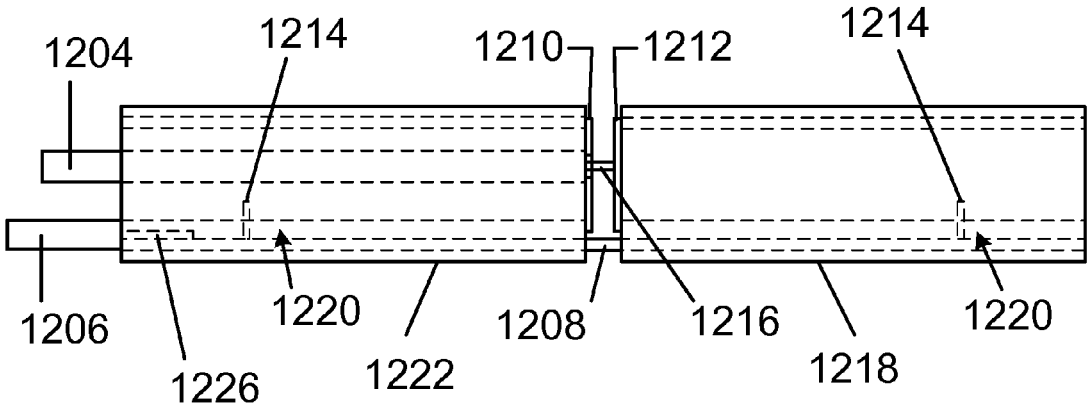
Fig. 12B
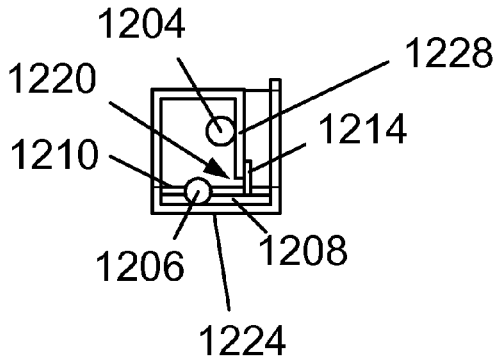
Fig. 12C
FIG. 12

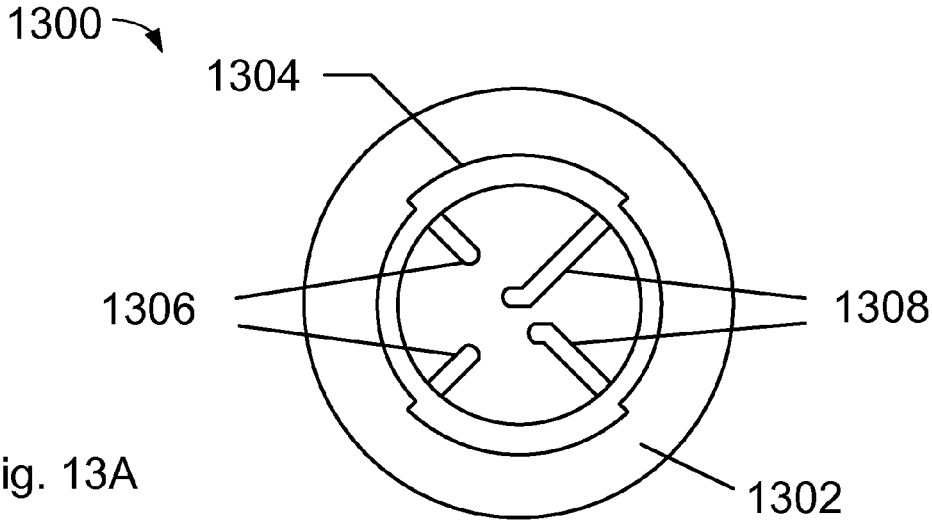
Fig. 13A
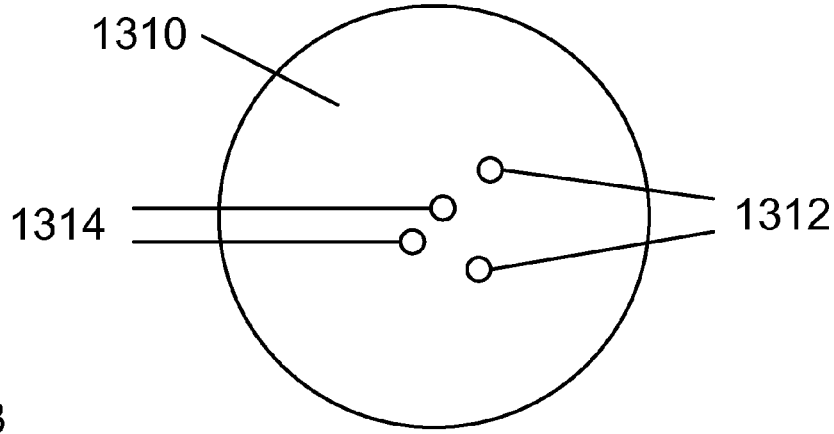
Fig. 13B
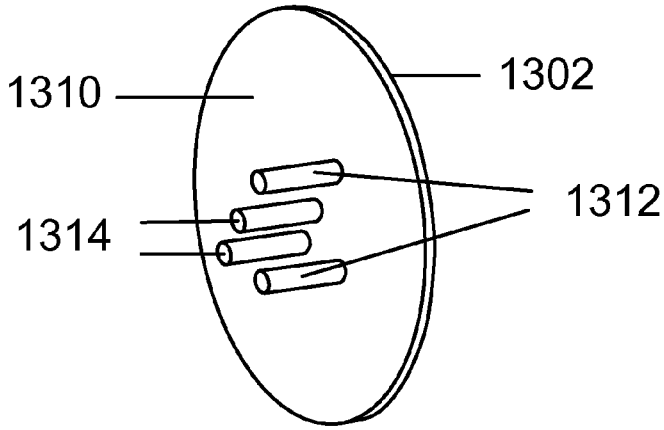
Fig. 13C
FIG. 13

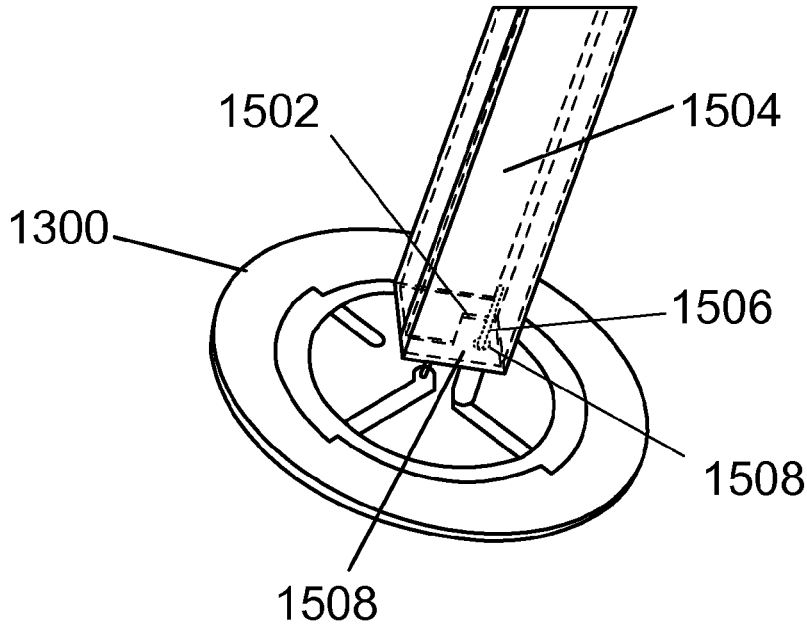
Fig. 15A
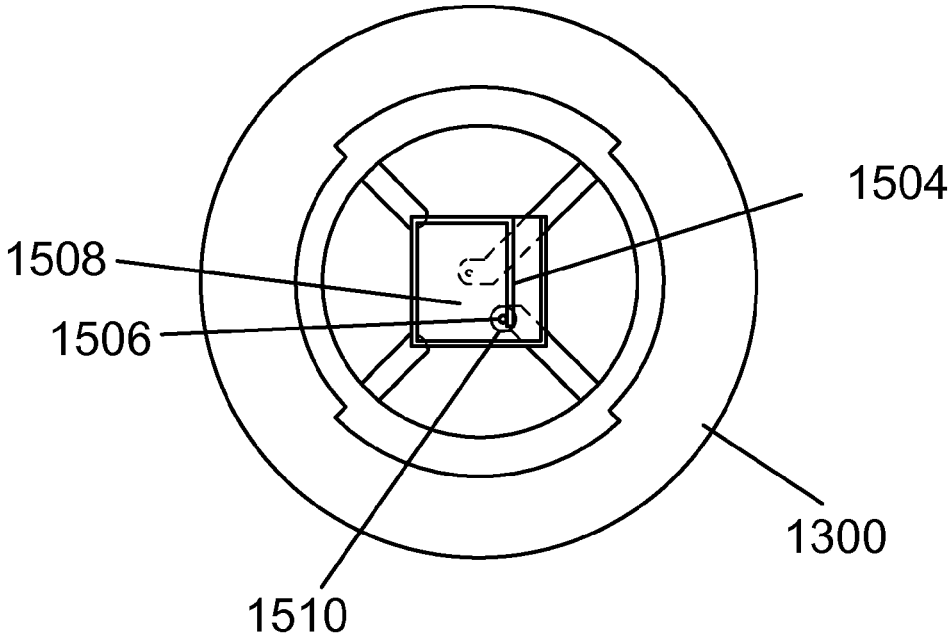
Fig. 15B
FIG. 15

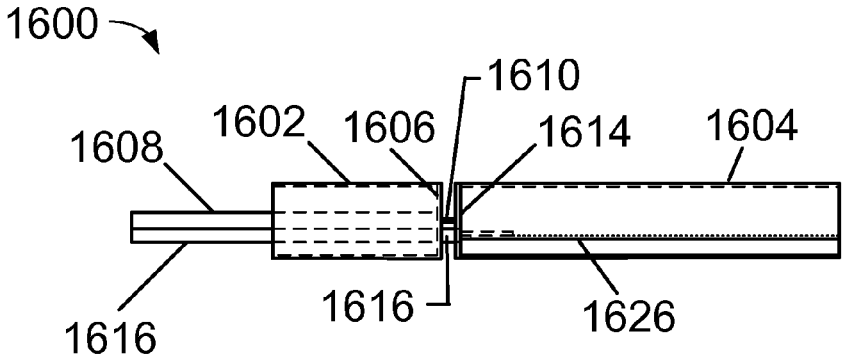
Fig. 16A
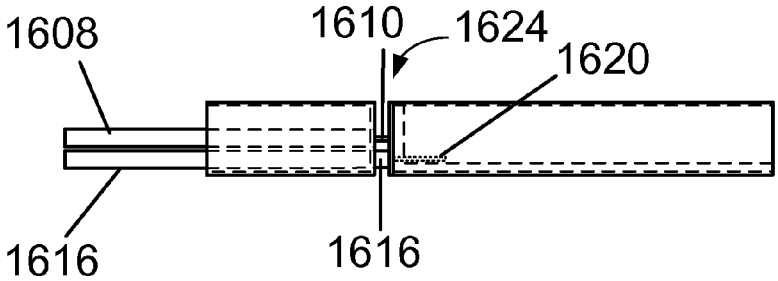
Fig. 16B
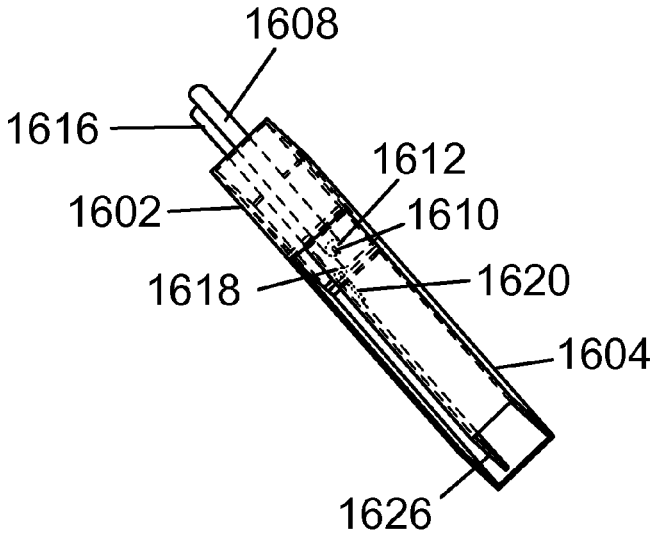
Fig. 16C
FIG. 16

1800

1900

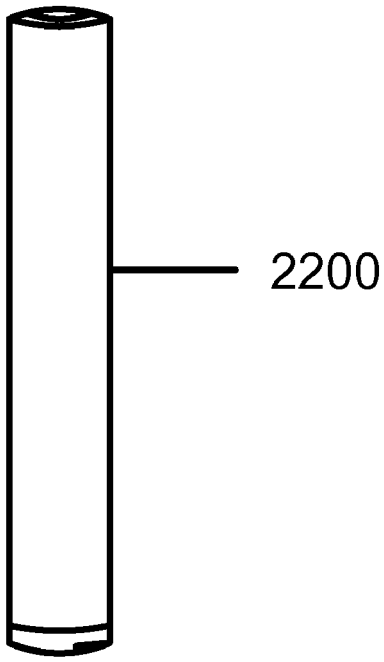
Fig. 22A
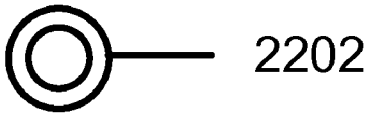
Fig. 22B
FIG. 22

COMPACT CIRCULARLY POLARIZED OMNI-DIRECTIONAL ANTENNA

REFERENCE TO RELATED APPLICATION

This patent application claims the benefit of U.S. Provisional Application Ser. No. 61/147,058, filed Jan. 23, 2009, the disclosure of which is incorporated by reference herein.

U.S. patent application Ser. No. 11/865,673, filed on Oct. 1, 2007, entitled "Horizontal Polarized Omni-Directional Antenna" and U.S. patent application Ser. No. 12/576,207, filed on Oct. 8, 2009, entitled "Spiraling Surface Antenna," describing omni-directional antennas, are herein incorporated by reference in their entirety.

BACKGROUND

Wireless communication has become an integral part of modern life in personal and professional realms. It is used for voice, data, and other types of communication. Wireless communication is also used in military and emergency response applications. Communications that are made wirelessly rely on the electromagnetic spectrum as the carrier medium. Unfortunately, the electromagnetic spectrum is a limited resource.

Although the electromagnetic spectrum spans a wide range of frequencies, only certain frequency bands are applicable for certain uses due to their physical nature and/or due to governmental restrictions. Moreover, the use of the electromagnetic spectrum for wireless communications is so pervasive that many frequency bands are already over-crowded. This crowding may cause interference between and among different wireless communication systems.

Such interference jeopardizes successful transmission and reception of wireless communications that are important to many different aspects of modern society. Wireless communication interference can necessitate retransmissions, cause the use of ever greater power outlays, or even completely prevent some wireless communications. Consequently, there is a need to wirelessly communicate with reduced electromagnetic interference that may hinder the successful communication of information. Use of horizontal polarization may improve communications reliability by reducing interference from predominantly vertically polarized signals in overlapping and adjacent frequency bands. Conversely the application of vertical polarization in an environment dominated by horizontally polarized interference may improve communications reliability.

Multipath fading results in reduced communications reliability, particularly where mobile devices pass through signal fades. Linearly polarized communications systems may generally be more susceptible to multipath fading than elliptically or circularly polarized systems. Mobile systems typically require an omni-directional antenna pattern on the client devices. An omni-directional antenna is characterized by an azimuthal radiation pattern that exhibits minimal antenna gain variation. Horizontally polarized omni-directional mobile antennas are rare and not readily available in the industry. Circularly polarized omni-directional mobile antennas are rarer still.

The continued drive toward miniaturization and the ubiquitous nature of wireless communication creates a need for small antennas. A properly sized and designed antenna may be retrofitted into existing installations or into applications which are small by their nature. An antenna that is compact, and still able to transceive circularly polarized signals efficiently, allows for the use of circular polarization in applications that would otherwise be difficult to implement unobtrusively.

SUMMARY

Example embodiments of antennas that can transceive signals in a horizontal, vertical, or elliptical polarization orientation, in particular circular polarization, and in an omni-directional manner are described. The exemplary embodiments of compact common-aperture, dual polarization (D-pol) antennas described herein can achieve any polarization orientation by applying judicious amplitude and/or phase modulation to the input ports. The phase and/or amplitude modulators may be internal and/or external to the antenna. In an example embodiment, an antenna comprises two electrically conductive surfaces, each surface forming an internal cavity. The first surface also forms a first opening configured to allow radio frequency (RF) energy access to the first internal cavity. The first surface is positioned proximate to the second surface, and the first surface and the second surface are collinearly aligned. The first surface and the second surface are separated by a predetermined distance, and a structural member comprising a printed circuit is coupled to both of the surfaces. The structural member supports the surfaces. The printed circuit comprises multiple conductors that are electrically coupled to the surfaces.

Alternate embodiments comprise various cross-sectional configurations, and may also comprise a radome at least partially surrounding the antenna.

While described individually, the foregoing embodiments are not mutually exclusive and any number of embodiments may be present in a given implementation. Moreover, other antennas, systems, apparatuses, methods, devices, arrangements, mechanisms, approaches, etc. are described herein.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

FIGS. 5A and 5B are example radiation patterns of a dipole antenna from two perspectives.

FIGS. 6A and 6B are example radiation patterns of a slotted antenna from two different perspectives.

FIGS. 12A, 12B and 12C illustrate three views of constructing an example spiraling surface antenna by coupling spiraling surface assembly portions with a single printed circuit as a supporting structure, according to one embodiment.

FIGS. 13A, 13B and 13C illustrate an example design for a circular microstrip quadrature hybrid according to one embodiment.

FIGS. 15A and 15B illustrate two close-up views of an example feed relationship between a circular microstrip quadrature hybrid from FIG. 13 and a spiraling surface antenna as described in FIG. 14.

FIGS. 16A, 16B, and 16C illustrate three views of a spiraling surface antenna, including feed lines, in which the two antenna elements are of different lengths.

FIGS. 22A and 22B illustrate an example of a radome configured to surround, at least partially, an antenna according to an example embodiment.

DETAILED DESCRIPTION

Introduction

Figure 1:
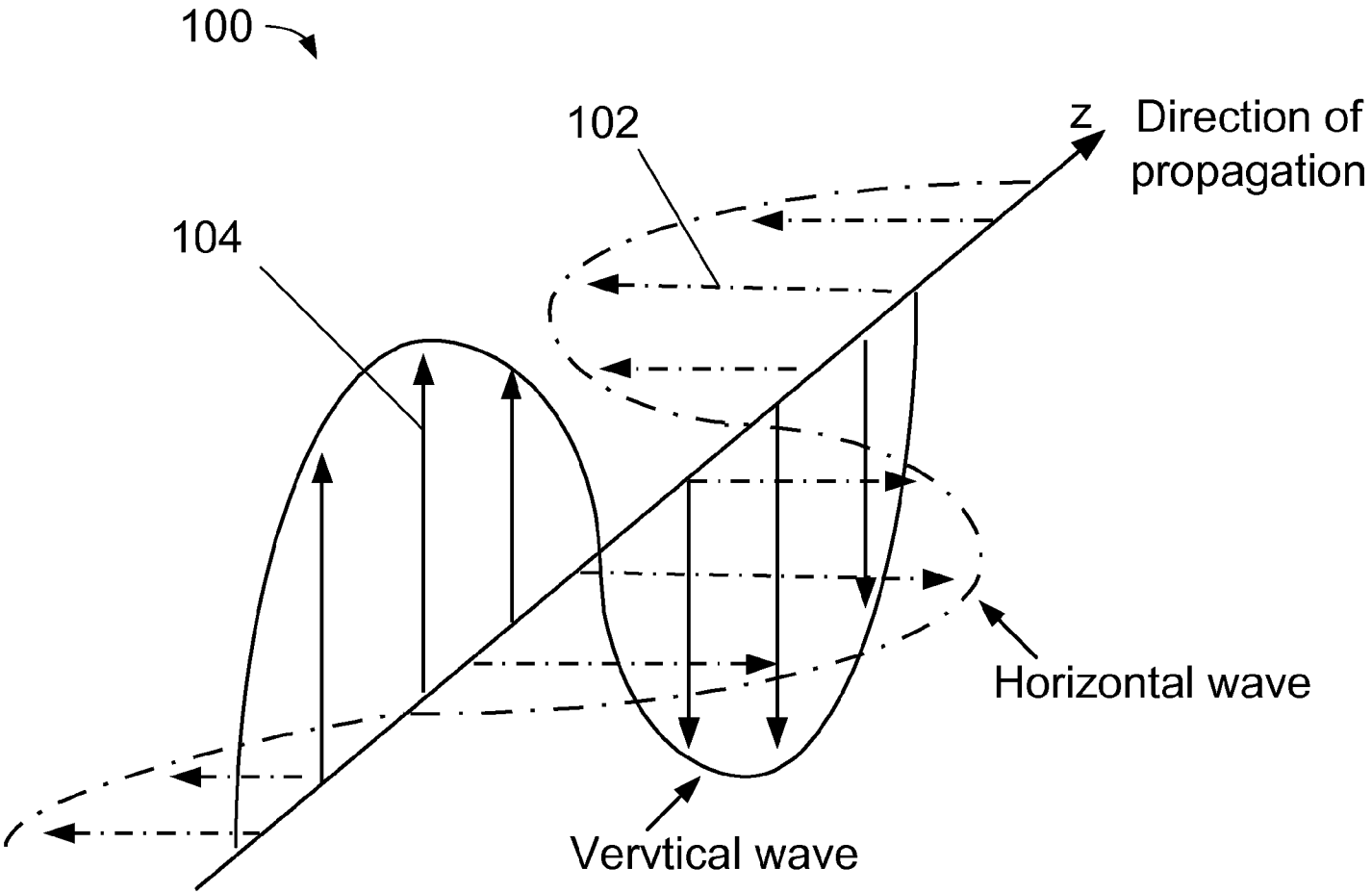
FIG. 1 illustrates a perspective view of two orthogonal waves, a vertical and a horizontal, with a 90° lead.

An antenna operated such that the electric field emanating from the antenna is parallel to a plane defined by the surface of the earth is said to be horizontally polarized. Note that a horizontally polarized antenna may be mounted or operated with the physical vertical axis of the antenna being substantially perpendicular to a plane defined by the surface of the earth, and still emanate an electric field that is parallel to the surface of the earth.

Compact circularly polarized antennas have not proliferated in the marketplace. Circularly polarized antennas that have been developed and marketed are relatively large, aesthetically obtrusive, have poor radiation patterns, or are impractical to manufacture in large quantities. The present application discloses various embodiments of an omni-directional dual polarized antenna that may be excited with modulated amplitude and phase to obtain a compact circularly polarized antenna that is relatively small, aesthetically similar to existing vertically polarized antennas, has excellent radiation characteristics and is practical to manufacture.

This disclosure addresses both interference rejection through polarization discrimination and resistance to multipath fading through a unique omni-directional dual polarization antenna structure which can implement any polarization from linear to circular, while presenting a slender visual cross section resembling an otherwise vertically polarized antenna.

Dual polarization antennas described are configured to transceive signals in a horizontal, vertical, or elliptical polarization orientation, and in an omni-directional manner. Example embodiments of compact common-aperture, dual polarization (D-pol) antennas described herein achieve any desired polarization orientation by applying judicious amplitude and/or phase modulation to input ports of the respective antenna.

Design Considerations

It is to be understood for the purposes of this application that reference to wavelength ($\lambda$) implies a wavelength within a medium, the medium having a permittivity of 1.0 (free space) or greater. The permittivity of the medium results in an alteration to the velocity of propagation of an electromagnetic waveform relative to free space. This results in a wavelength that is shorter in non-free space media. The formula for a wavelength within a medium is as follows:

$$\lambda=\lambda_o/(\in_r)^{1/2}$$

where:

$\lambda$=wavelength in the medium $\lambda_o$=free space wavelength $\in_r$=permittivity of the medium It is also to be understood for the purposes of this application that, as will be discussed in detail, any two orthogonal linearly polarized electromagnetic waves can be modulated to produce a vector sum that results in all possible electromagnetic wave polarizations. For convenience and clarity of discussion, the two orthogonal components are referred to herein as "vertical" and "horizontal" with respect to the earth's surface; however, physical installations need not be deployed as vertical or horizontal.

Radiation emanating from an antenna is said to originate from a phase center. The phase center of an antenna is an imaginary point that is considered to be the source from which radiation occurs. The phase center of the radiation emanating from an antenna is sometimes also the physical center of the antenna, but in many cases it is not. In many cases, the phase center may not be on the antenna, but may be in space some distance from the antenna. The phase center of an antenna designed using a spiraling surface may be within the interior of the antenna, at a predetermined location either at or near the aperture.

The location of the phase center may not be the same as the physical origin of radiated energy within an excited spiraling surface antenna. The physical origin of the radiated energy is often at a coupling gap within a cavity formed by the spiraling surface. An antenna designed using a spiraling surface has a generally increasing radius from the coupling gap to the surface walls of the antenna as a generated electric field travels from the physical point of origin through the antenna chambers and is radiated out of the aperture of the spiraling surface antenna.

Omni-directional circular polarization can be achieved by aligning two linearly polarized omni-directional antennas so that one is orthogonal and generally coplanar to the other and their phase centers are generally coincident. The radiated signal amplitudes from each antenna may be generally equal. The electric field vectors of both antennas may have a relationship such that their vector sum will have generally constant amplitude as the field rotates while traveling through space. Two orthogonal waves, a vertical and a horizontal, with a 90° lead are illustrated in FIG. 1, and vector summations of the two waveforms described in FIG. 1 are illustrated in FIG. 2.

Figure 2:
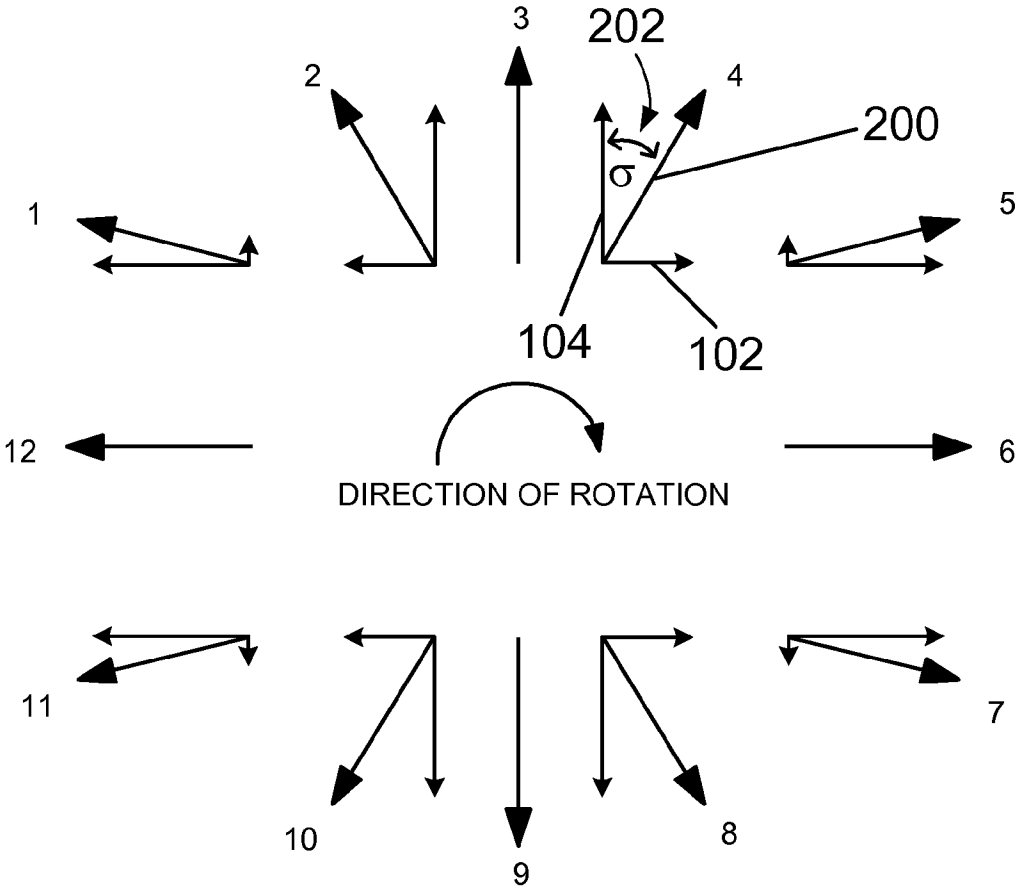
FIG. 2 illustrates vector summations of the two waveforms described in FIG. 1.

With reference to FIGS. 1 and 2, consider two electric field quantities, $E_x$ 102 and $E_y$ 104, in the same plane traveling in the positive z direction. FIG. 1 is a sketch of two example orthogonal sinusoidal waves 102 and 104.

$$E_x=A_x\cos(\omega t-z/v) \tag{1a}$$

$$E_y=A_y\cos\{(\omega t-z/v)+\xi\} \tag{1b}$$

For convenience assume the fields lie in the z=0 plane. This simplifies the set of parametric equations to $$E_x=A_x\cos(\omega t) \quad (2a)$$

$$E_y=A_y\cos(\omega t+\xi) \quad (2b)$$

Using the trigonometric addition formula for the cosine function, we get for equation 2b $$A_y\cos(\omega t+\xi)=A_y\cos(\omega t+\xi)+A_y\sin(\omega t)\sin(\xi) \quad (3)$$

Letting $\xi=\lambda/2$, equation 3 reduces to $$A_y\cos(\omega t+\pi/2)=A_y\sin(\omega t) \quad (4)$$

Incorporating these simplifications, we rewrite the parametric equation (2)

$$x=a\cos(\omega t) \quad (5a)$$

$$y=b\sin(\omega t) \quad (5b)$$

Squaring the parametric equations (5)

$$x^2=a^2\cos^2(\omega t) \text{ or } x^2/a^2=\cos^2(\omega t) \quad (6a)$$

$$y^2=b^2\sin^2(\omega t) \text{ or } y^2/b^2=\sin^2(\omega t) \quad (6b)$$

Adding (6a) and (6b) we get $$x^2/a^2+y^2/b^2=\cos^2(\omega t)+\sin^2(\omega t) \quad (7)$$

Recall the trigonometric identity $\cos^2(\omega t)+\sin^2(\omega t)=1$, (7) can be put into the form $$x^2/a^2+y^2/b^2=1 \quad (8)$$

Equation (8) is the standard equation for an ellipse centered at the origin (0,0) in the Cartesian coordinate system. This shows that when two orthogonal field vector quantities having a common starting point are phased 90° apart, they produce a vector sum 200 with the tip of the vector tracing out an elliptical path as they travel through space, hence, describing an elliptical polarization. FIG. 2 illustrates the vector summations of the two waveforms for a full cycle. At one point in time, $E_x$ 102 is predominant with no $E_y$ 104, but in the next instant the magnitude of $E_x$ 102 diminishes and magnitude of $E_y$ 104 grows. The vector sum changes its angular position $a_s$ the magnitudes of $E_x$ 102 and $E_y$ 104 change. Because the orthogonal waves 100 are moving away from the source in the illustration of FIG. 2, the vector sum 200 also is moving away from the source while its angular position changes, so the tip of the vector traces out a helical (corkscrew) path as the wave moves in space. If the constants a and b are equal, equation (8) reduces to the standard equation of a circle. Ergo, to achieve a circularly polarized antenna, two radiators may be oriented so that their electric field (E-field) vectors are orthogonal to each other, each radiator having equal power, and their respective phase centers in generally the same location. One radiator is phased so that its E-field vector either leads or lags in electrical phase by approximately 90° from the other.

From this discussion it can also be shown that any desired elliptical or linear polarization can be realized in an omni-directional pattern by modulating the relative phase ($\xi$) and the individual amplitudes ($A_x$ and $A_y$) of the two orthogonal E-fields.

Accordingly, one embodiment of an omni-directional dual polarization (D-pol) antenna comprises a first phase modulator configured to adjust a phase of a first signal being carried on at least one of multiple conductors; a first amplitude modulator configured to adjust a magnitude of the first signal; and a second amplitude modulator configured to adjust a magnitude of a second signal being carried on at least one other of the multiple conductors, such that a vector sum of the first signal and the second signal may be configured to produce a desired gain and a desired polarization with respect to transmission and/or reception of the antenna.

Figure 3:
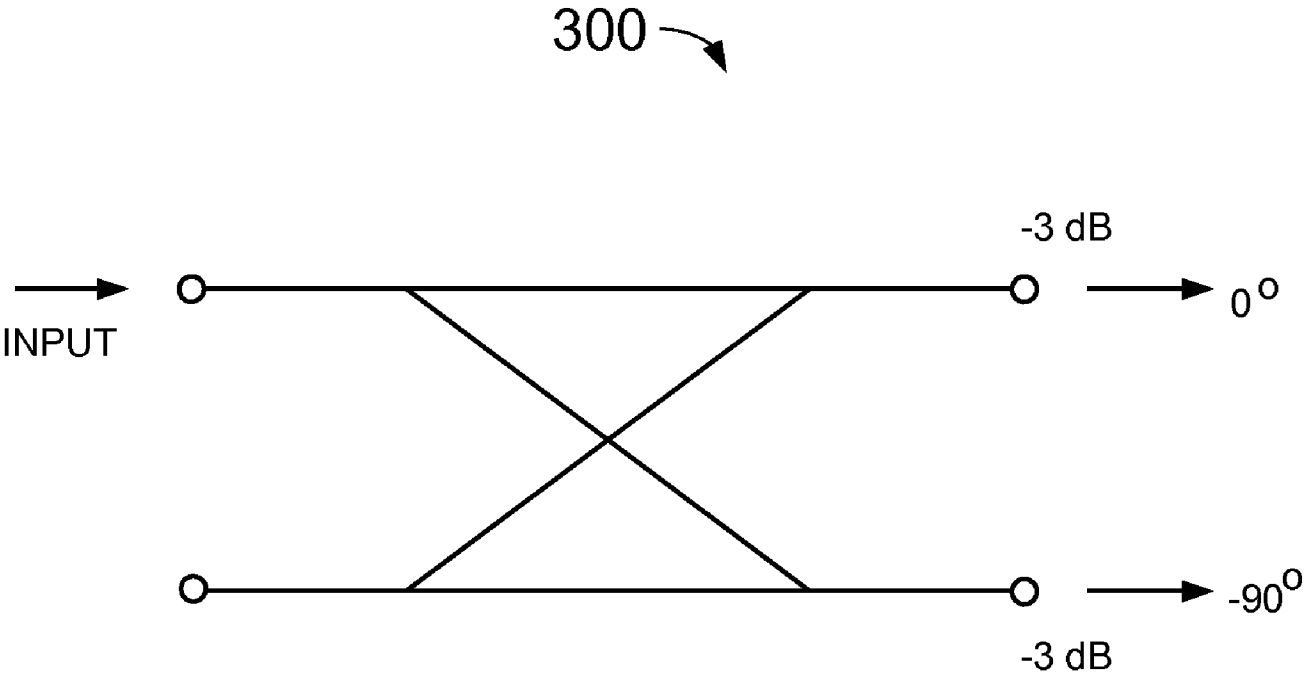
FIG. 3 is a schematic of an example quadrature hybrid, according to an embodiment.

The required amplitude and phase relationships to implement circular polarization using orthogonal linear antennas can, in one example, be realized by utilizing a quadrature hybrid. A quadrature hybrid is one method of constructing a vertical and horizontal signal to create a circular polarization. FIG. 3 is a schematic of an example quadrature hybrid 300. In one example, a quadrature hybrid 300 may be a four port network having two input ports and two output ports. Introducing a signal in one of the input ports produces signals at the output ports that are equal in amplitude, (half of the input power (−3 dB) at each output port). However, one output port will have a zero delay while the other output port will have a 90° phase delay. Applying a signal into the other input port produces the same result, except that the phase delay in the output ports are interchanged. Hence signals fed in one input port produces a right-hand circular polarized radiated E-field vector and signals fed in the other produces a left-hand circular polarized radiated E-field vector, when the outputs are applied to the orthogonal antennas.

Figure 4:
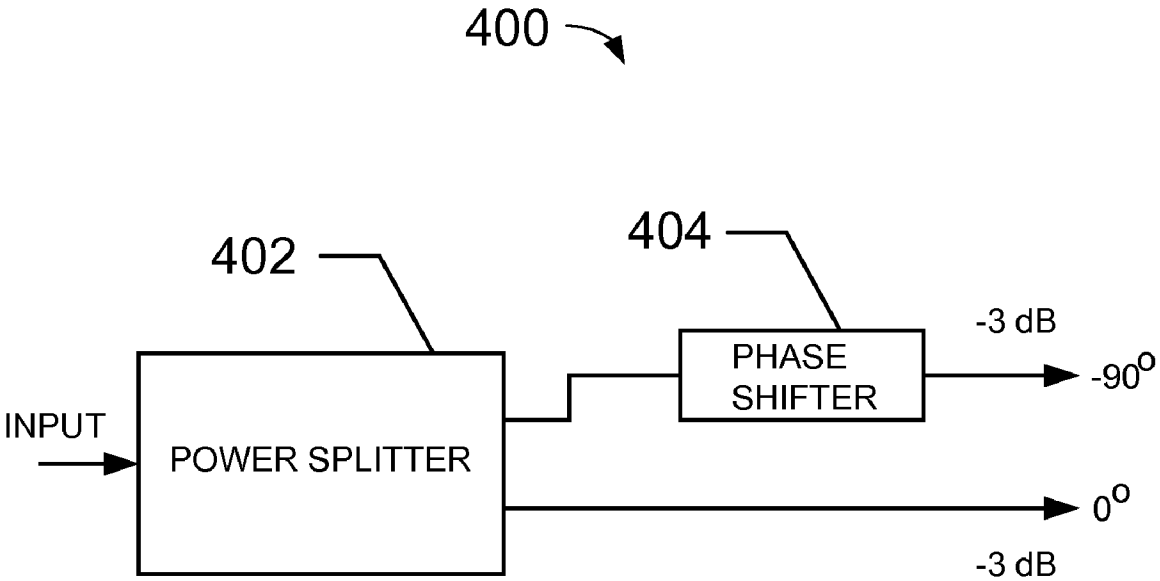
FIG. 4 is a schematic of an example power splitter-phase shifter according to an embodiment.

A similar result can be obtained by using a −3 dB power divider 402 and a $\lambda/4$ line length differential or phase shifter 404 in the feed line to one of the radiators. FIG. 4 is a schematic illustration of an example power splitter/phase shifter 400. If the example power splitter/phase shifter 400 is applied to two orthogonally polarized antennas that are omni-directional in the same plane, then the result is omni-directional circular polarization in that plane.

Referring again to FIG. 2, if no phase difference is introduced to either of the orthogonal signals 102 and 104, and the relative amplitude of the orthogonal signals are varied, the vector sum 200 producing a radiated field vector can be oriented to any spatial angle $\sigma$ 202 between vertical and horizontal; thus any linear polarization may be achievable. When both orthogonal signals 102 and 104 are in phase (no electrical phase difference) and relative amplitudes are constant, the polarization angle 202 remains constant.

Electro-Mechanical Considerations

For the purposes of this disclosure, the omni-directional dual polarization (D-pol) antennas described herein may be understood to have the electro-magnetic wave tranceiving properties and characteristics of both a dipole antenna and a slot antenna. By way of introduction, a general dipole antenna and a general slot antenna, with their respective properties and characteristics, are discussed in this section. Throughout the disclosure, however, the D-pol antenna embodiments discussed may be discussed in relation to the dipole antenna and slot antenna properties and characteristics they possess.

Referring to FIGS. 5 and 6, a dipole antenna 502 and a slot antenna 602 have nearly identical radiation characteristics. FIGS. 5 and 6 illustrate the dipole 502 radiation pattern 500 and the slot antenna 602 radiation pattern 600, respectively. A vertically oriented dipole 502 produces an E vector 506 that is vertical. This field is generally constant around the axis of the dipole 502 and produces an omni pattern in the azimuth plane. The field in the elevation plane diminishes as it approaches the ends of the dipole 502 and so the 3-D radiation pattern shape is similar to that of a torus. FIG. 5 is a sketch of a dipole 502 radiation pattern 500. FIG. 5A is a cross sectional side view showing the elevation pattern 504 with the E vector 506 vertically polarized. A typical half power beam width is about 78 degrees. FIG. 5B shows the omni-directional H-plane pattern 508. In FIG. 5B, the E vector is shown as a point of the arrowhead.

A conductive surface formed to have an opening, and excited with radio frequency energy may be referred to as a slot antenna. The opening formed may therefore be referred to as a slot. Referring to FIG. 6, a slot in a generally smaller diameter cylinder and oriented with its axis vertical, will have the E vector horizontal and omni-directional in the azimuth plane when excited. The elevation pattern 604 will be identical to that of the elevation pattern of the dipole 502, and is generally about 78 degrees at the half power points. For convenience, the slot antenna 602 illustrated in FIG. 6A is shown as generally cylindrical, and is often referred to in this disclosure as a cylinder, or a slotted cylinder. However, the slot antenna 602 can have other cross sections in various embodiments, for example a spiraling cross section, a polygonal cross section, an elliptical cross section, and the like.

FIG. 6A shows the orientation of the H field vector 606. In this view, although not shown, the E vector 506 is perpendicular to the H vector 606 and into (or out of) the plane of the drawing. FIG. 6B shows the omni-directional E-plane pattern 608. Several E vectors 506 are shown around the circular E-plane pattern 608 to illustrate and emphasize the horizontally polarized E vector 506 attribute.

Example Antenna Embodiments

Figure 7:
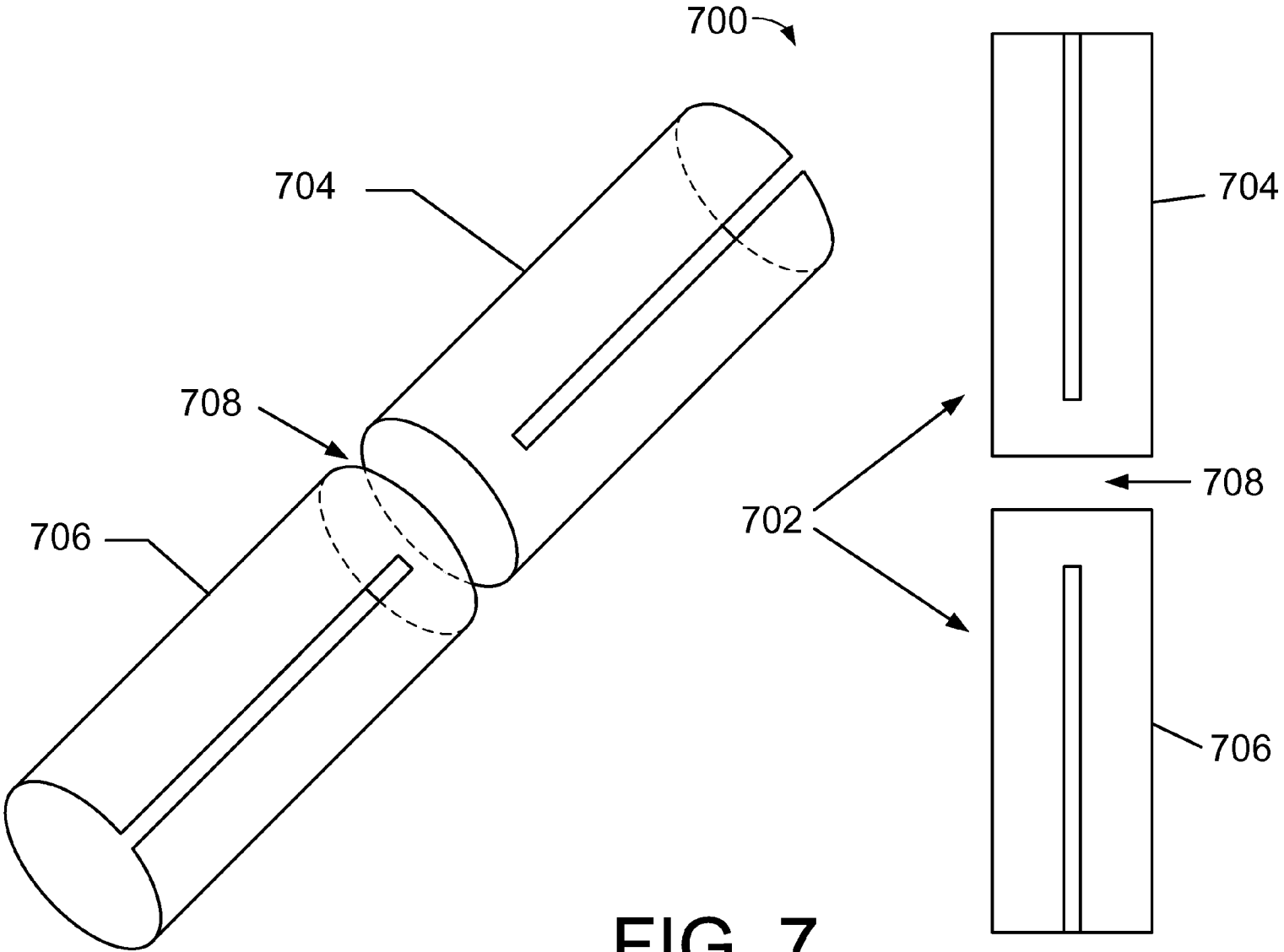
FIG. 7 illustrates an example of two slotted cylinders, from two perspectives, arranged to form a dual polarized antenna.

Referring to FIG. 7, an example common aperture dual polarization (D-pol) antenna 700, as mentioned above, may be constructed using two λ/4 slotted cylinder sections 702. A slotted cylinder section 702 may be formed from a surface, formed to have a cross sectional shape, such as a circular cylinder. In alternate embodiments, a slotted cylinder section 702 may have another cross sectional shape, for example, a spiraling cross section, a polygonal cross section, an elliptical cross section, and the like. Each of the slotted sections 702 may be closed, or continuous around the perimeter of the cylinder, at the inside ends, and may also be closed at the outside ends with conductive or non-conductive end caps or with a combination of both types on either members. In one embodiment, this construction provides for the juxtaposition of the dipole and slotted antenna properties and characteristics in a single device. For example, the slotted sections 702 may be closed at the inside ends to create a current path around the slotted sections 702 to configure the dipole antenna 502, and for suitable excitation of the orthogonal fields of the slot antenna 602.

In one example, the two slotted sections 702 are physically separated into an upper cylinder 704 and a lower cylinder 706 forming a transverse gap 708 between them, with their axes collinear to form dipole arms. FIG. 7 is a drawing illustrating the configuration, which forms a dipole pair. The dipole pair has a phase center located on the major axis of the dipole pair and centered within the transverse gap. The two slotted sections 702 form a slot antenna with a phase center nearly co-incident with that of the dipole.

Accordingly, an example D-pol antenna 700 may be constructed using two electrically conductive surfaces 704 and 706, the two surfaces forming internal cavities. In one example, illustrated in FIG. 7, the forming results in two cylindrical sections 702. In one embodiment, the first surface 704 may be formed to have an opening or slot, where the opening is configured to allow radio frequency (RF) energy access to the first internal cavity. In another embodiment, the second surface 706 may also be formed have an opening or slot, the opening configured to allow radio frequency (RF) energy access to the second internal cavity.

In one embodiment, as illustrated in FIG. 7, the first surface 704 is positioned proximate to the second surface 706, the first surface 704 and the second surface 706 being collinearly aligned, such that the first surface and the second surface are separated by a predetermined, desired distance. In one example the first surface 704 and the second surface 706 may have different cross-sectional shapes. In a further embodiment, the first surface 704 and the second surface 706 are electrically coupled. The first surface 704 may be coupled to the second surface 706 to provide a consistent orthogonal component 102 across the slotted sections 702.

In an alternate embodiment, which will be discussed in detail below, an example D-pol antenna 700 may include a structural member configured to support the first surface 704 and/or second surface 706. In one embodiment, the structural member may comprise a printed circuit, for example, the printed circuit may have a number of conductors electrically coupled to the first surface 704 and/or second surface 706.

Alternately, a common aperture D-pol antenna 700 may be constructed with one λ/4 length slotted cylinder section and one non-slotted cylinder section. This configuration reduces the aperture of the horizontal polarization antenna while moving the corresponding phase center away from the transverse gap along the major axis of the sections 702. For example, an antenna 700 may be constructed wherein the first surface 704 and the second surface 706 are unequal in length and wherein a shorter of the first and second surfaces includes an end cap sealed at an end proximal to the longer of the surfaces 704 or 706, and the shorter surface is configured to act as an RF choke for the antenna.

Accordingly, a D-pol antenna 700 may be configured such that the first surface 704 and the second surface 706 form a dipole 502, where the dipole 502 is configured to produce a first linearly polarized omni-directional electromagnetic wave, and the D-pol antenna 700 is further configured such that an opening in the first surface 704 and an opening in the second surface 706 are configured to produce a second omni-directional electromagnetic wave that is orthogonally polarized relative to the first linearly polarized electromagnetic wave.

Further Example Embodiments and Excitation Methods

Figure 8:
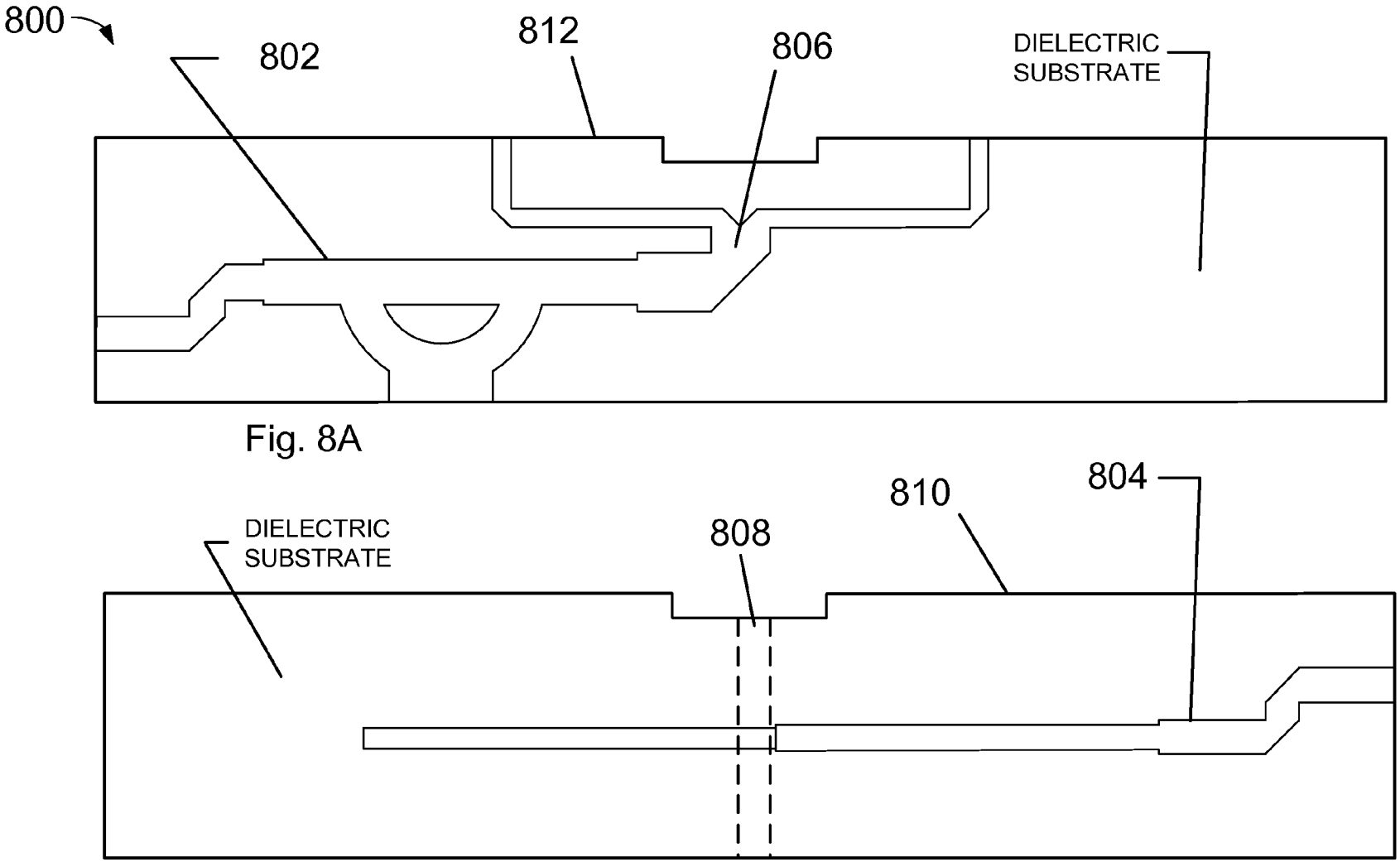
FIGS. 8A and 8B illustrate two sides of an exemplary printed circuit with microstrip antenna feed lines for horizontal and vertical polarization, respectively.

Exciting or feeding the slotted sections 702 can be fairly complex if the physical dimensions within the slotted sections 702 place size constraints that may limit design flexibility. One example method, illustrated in FIG. 8, is feeding the slotted sections 702 using printed circuits 800, including conductive feed lines. In alternate embodiments, other types of conductors may be used, for example, conductors may include feeds, feed lines, ground planes, terminals, connectors, traces, wires, cables and other types of transmission lines, devices, and the like. In the illustrated example in FIG. 8, the feed lines for the dipole 502 and the slot antenna 602 portions of the antenna 700, are the horizontal microstrip feed line 802 and the vertical microstrip feed line 804. The slots in both slotted sections 702 may be fed using a power splitter 806, for example. FIG. 8A is a drawing showing printed circuits 800 employing this method.

The terms "couple" or "coupling" are used in the following discussion to refer to energy transfer from one conductor to another conductor, as including a physical connection or a nonphysical connection. A nonphysical connection may include inductive and/or capacitive methods. In an example, a dipole 502 is fed via a slot-line 808 that couples energy from the vertical microstrip feed line 804 shown in FIG. 8B.

For example, in one embodiment, an antenna 700 may include a printed circuit 800, where the printed circuit 800 is also a structural member of the antenna 700. The printed circuit 800 may be a support for the two surfaces 702. In one example the printed circuit 800 includes multiple conductors electrically coupled to the two surfaces 702. In another embodiment, the printed circuit 800 is located partially within the first internal cavity of the first surface 704 and partially within the second internal cavity of the second surface 706, where the printed circuit 800 is further configured to provide structural support to the first surface and/or the second surface.

In a further embodiment, the printed circuit 800 is curved in its geometry, non-planar, flexible, or the like. For example, the printed circuit 800 may be formable into a curved or formed geometry, such as with a flexible printed circuit. For another example, the printed circuit 800 may be comprised of conductors and a generally fluid dielectric, including an air dielectric, and still be capable of providing structural support to the surfaces 704 and/or 706.

Figure 9:
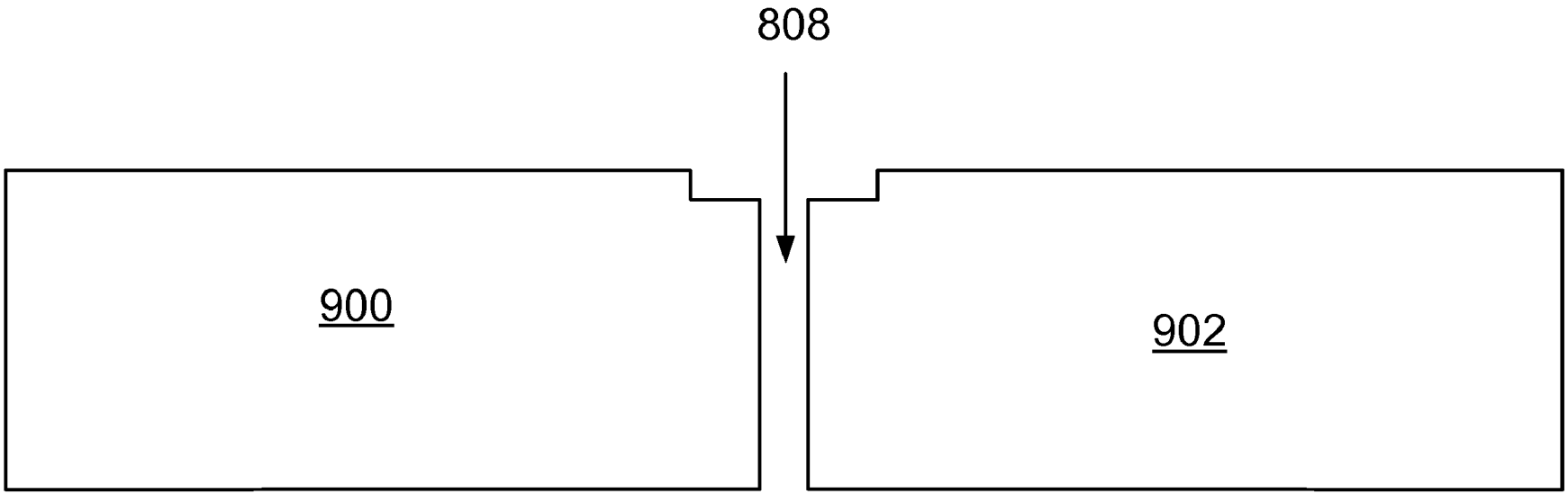
FIG. 9 illustrates an exemplary ground plane for the microstrip as described in FIGS. 8A and 8B, with a portion of the ground plane etched away, revealing a slot line
Figure 11:
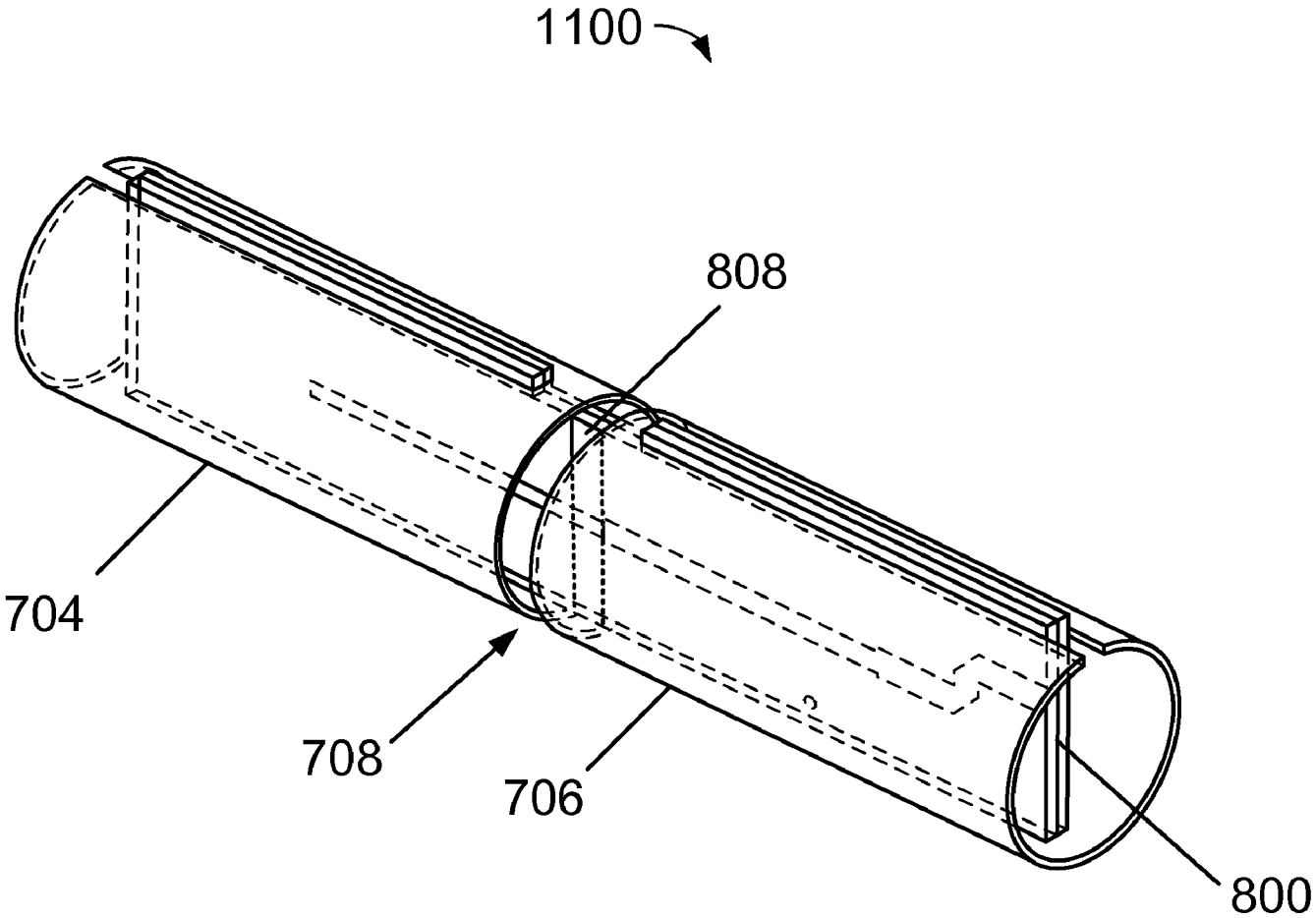
FIG. 11 illustrates an assembled common aperture antenna utilizing the printed circuit as described in FIG. 9, and two slotted cylinders as described in FIG. 7, according to one embodiment.

The slot-line 808 is also illustrated in FIG. 9. In one example, as illustrated in FIG. 9, the slot-line 808 is formed when two halves of a common ground layer 900 and 902 are arranged proximate to each other. In one embodiment, the two halves of the common ground layer 900 and 902 are ground planes for the horizontal microstrip feed line 802 and vertical microstrip feed line 806 respectively. The two halves of the common ground layer 900 and 902 may be embedded between the vertical printed circuit 810 and horizontal printed circuit 812. The two halves of the common ground layer 900 and 902 may be coupled to the two surfaces 704 and 706. (FIG. 11 illustrates an example of an assembled common aperture antenna 1100, with this configuration.)

In one embodiment, a printed circuit 800 comprises a first electrically conductive feed configured to induce a first electric field across the first opening to energize a horizontal component 102 of an electromagnetic wave, and a second electrically conductive feed electrically coupled to the first surface and configured to induce a second electric field across the first and second surfaces to energize a vertical component 104 of the electromagnetic wave.

In one embodiment, a printed circuit 800 is a multilayered printed circuit. In one example, the printed circuit 800 comprises a first layer comprising a first electrical conductor, the first electrical conductor configured to energize a horizontal component 102 of an electromagnetic wave; a second layer comprising a dielectric material; a third layer comprising a second electrical conductor, the second electrical conductor configured as a ground for the first and third electrical conductors, the second electrical conductor being electrically coupled to the first surface 704 or the second surface 706; a fourth layer comprising a dielectric material; a fifth layer comprising a third electrical conductor, the third electrical conductor configured to energize a vertical component 104 of the electromagnetic wave; a sixth layer comprising a dielectric material; and a seventh layer comprising a fourth electrical conductor, the fourth electrical conductor configured as a ground for the third electrical conductor, the fourth electrical conductor being electrically coupled to the first surface 704 and the second surface 706.

Figure 10:
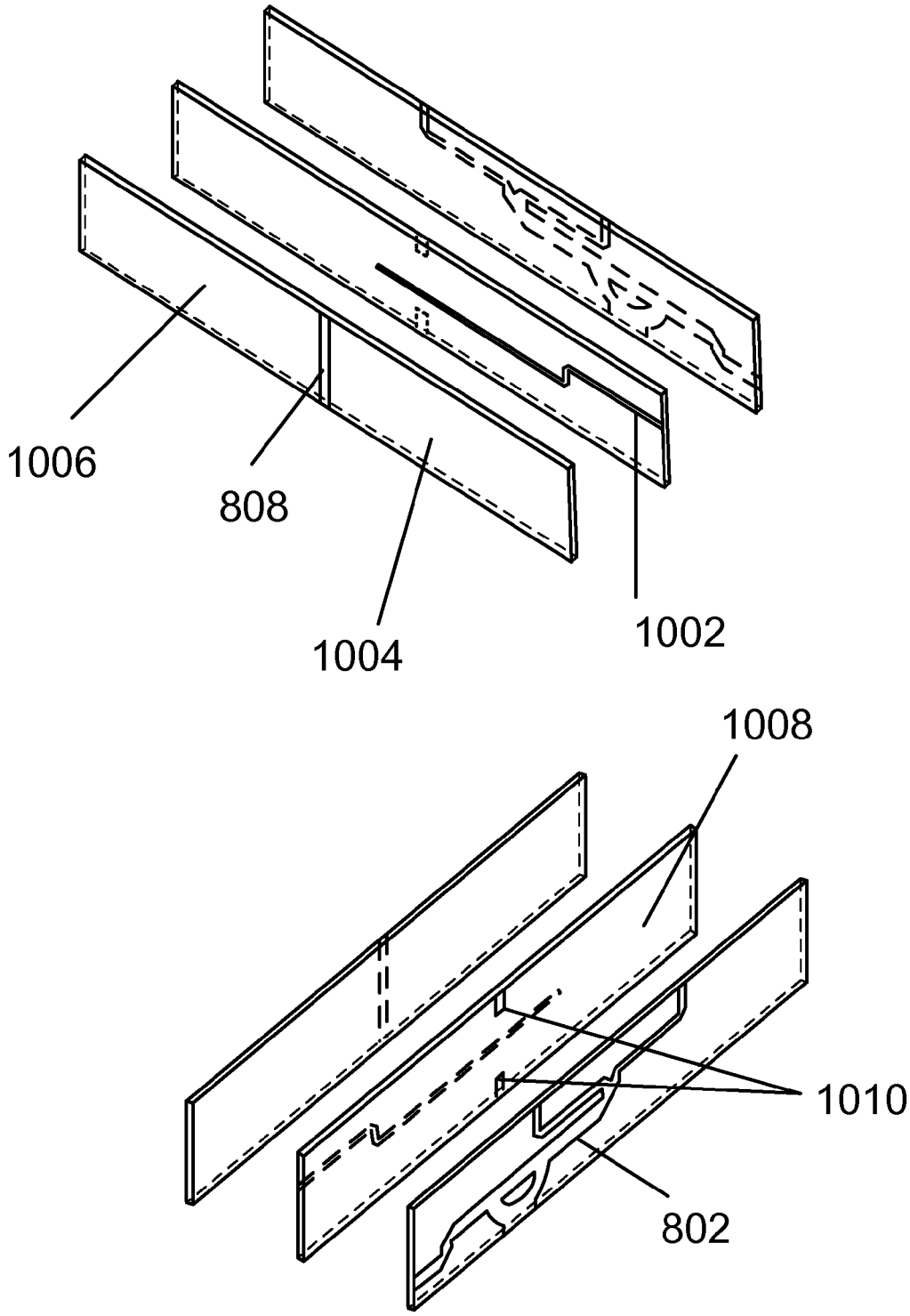
FIG. 10 illustrates two perspectives of an exploded view of a stripline and microstrip combination of printed circuits, as a variation of the printed circuit described in FIG. 9.

FIG. 10 illustrates exploded perspective views of a stripline/microstrip feed line printed circuit 800 embodiment. This embodiment is a variant of the method illustrated in FIG. 8. In one example, a vertical feed line is embedded as a stripline 1002 and the slot-line 808 is on the outer ground plane 1004. In one example, the slot-line halves 1004 are coupled to the two cylinders 704 and 706 at the transverse gap 708. In one embodiment, a common ground plane 1008 is a continuous sheet of conducting material with a small section of the material removed, forming a notch 1010, located at the edges where the ground plane contacts the inner surface of the two cylinders 704 and 706. The notch 1010 is configured to reduce, if not prevent an occurrence of a short at the transverse gap 708. In that way, the electric field induced by the slot-line 808 between the two cylindrical halves, is continuous along the perimeter of the transverse gap. Hence, the two cylinder halves 704 and 706 may be maintained as separate dipole arms.

FIG. 11 exemplifies the assembly of a common aperture antenna 1100 using either of the described feeding methods.

In one embodiment, conductors comprise a first distribution member electrically coupled to the first surface 704 to distribute electrical energy to substantially evenly energize the first surface 704, and a second distribution member electrically coupled to the second surface 706 to distribute electrical energy to substantially evenly energize the second surface 706. In one example, the distribution members may be the horizontal microstrip feed line 802 and the vertical microstrip feed line 804. In another example, the distribution members may be the two halves of the common ground layer 900 and 902. In a further example, the distribution members may be the slot-line halves 1004 and 1006. In one embodiment the distribution members are substantially planar, are co-planar, and are separated by a predetermined gap. In alternate embodiments, the distribution members are not planar. For example, the distribution members may have a curved or flexible geometry.

As mentioned above, one embodiment of a horizontally polarized antenna referred to as a Spiraling Surface Antenna ("SSA") is described in copending patent application Ser. No. 12/576,207. In one embodiment, as illustrated in FIG. 12, an SSA design 1200 can also be utilized as a common aperture, omni-directional dual polarization (D-pol) antenna 700, as has been discussed with respect to a slotted cylinder design 1100. As with the design of two $\lambda/4$ slotted cylinders 702 described in the above discussion, two $\lambda/4$ SSAs 1218 and 1222, with their axes aligned can be fed similarly with coaxial cables, microstrip lines, a combination of both, or other suitable conductors. FIG. 12 illustrates one method of feeding the SSA common aperture antenna 1200.

FIG. 12A is a top view of the device 1200 showing a trace of the microstrip line 1202, the vertical feed cable 1204 and horizontal feed cable 1206, the printed circuit 1208, and the end caps 1210 and 1212. FIG. 12B is a side view showing the location of the printed circuit 1208, the SSA feeds 1214, and the vertical polarization feed 1216 terminating at the upper SSA 1218 end cap 1212. FIG. 12C is an end view showing the relative locations of the feed cables 1204 and 1206, the printed circuit 1208, the SSA feed 1214, and the coupling gap 1220. In one embodiment, the printed circuit 1208 may comprise the electrical energy distribution members discussed above, with respect to SSA elements 1218 and 1222.

In one example, an SSA antenna may be configured as a pair of SSA elements. In an embodiment, a vertical polarization feed cable 1206 is run inside one of the SSA elements 1222. The outer shield of a coaxial cable forming the vertical polarization feed cable 1206 is terminated and affixed to a lower end cap 1210. A clearance hole in the lower end cap 1210 allows a center conductor of the vertical polarization feed 1216 to continue to the opposite upper end cap 1212 where it is terminated and affixed to the upper end cap 1212. The outer shield of the horizontal feed cable 1206 terminates and is affixed to a SSA wall 1224 at the open end of one SSA element 1222. The center conductor 1226 of the horizontal feed cable 1206 continues for approximately $0.05\lambda$, along the microstrip line 1202 and is affixed to the microstrip line 1202. In one example, SSA feed probes 1214 are used to excite electric fields along the coupling gap 1220 of the SSA elements 1218 and 1222. These probes 1214, spanning the coupling gap 1220, as shown in FIGS. 12B and 12C, are affixed to the microstrip 1202 and an inner wall 1228 of the SSA. The upper 1218 and lower 1222 SSAs may be end capped at their outer ends (not shown) with one outer end cap having clearance holes to accommodate the feed cables 1204 and 1206.

Example Orthogonal Polarization Techniques

The common aperture antenna 700, 1100, and 1200 approaches discussed in the previous paragraphs generates two orthogonal polarizations. To achieve circular polarization, as discussed above, a quadrature hybrid (QH) may be utilized. FIG. 3 is a schematic sketch of a QH 300. The output ports of the hybrid are connected to the vertical and horizontal feeds of the common aperture antenna 700, 1100, or 1200. Both senses of circular polarization are achieved using both of the input ports. One port will be right hand circular and the other will be left hand circular depending on which of the two feeds are connected to the output ports of the QH 300. FIG. 13 illustrates an example circular microstrip quadrature hybrid design 1300 etched on a copper clad laminate 1302, for example. FIG. 13A illustrates an example microstrip 1304 design with two input arms 1306 and two output arms 1308 of the QH 300. FIG. 13B shows the backside ground layer 1310, the input cables 1312, and the output cables 1314. FIG. 13C is a perspective view of the QH design 1300.

Other Example Embodiments

Figure 14:
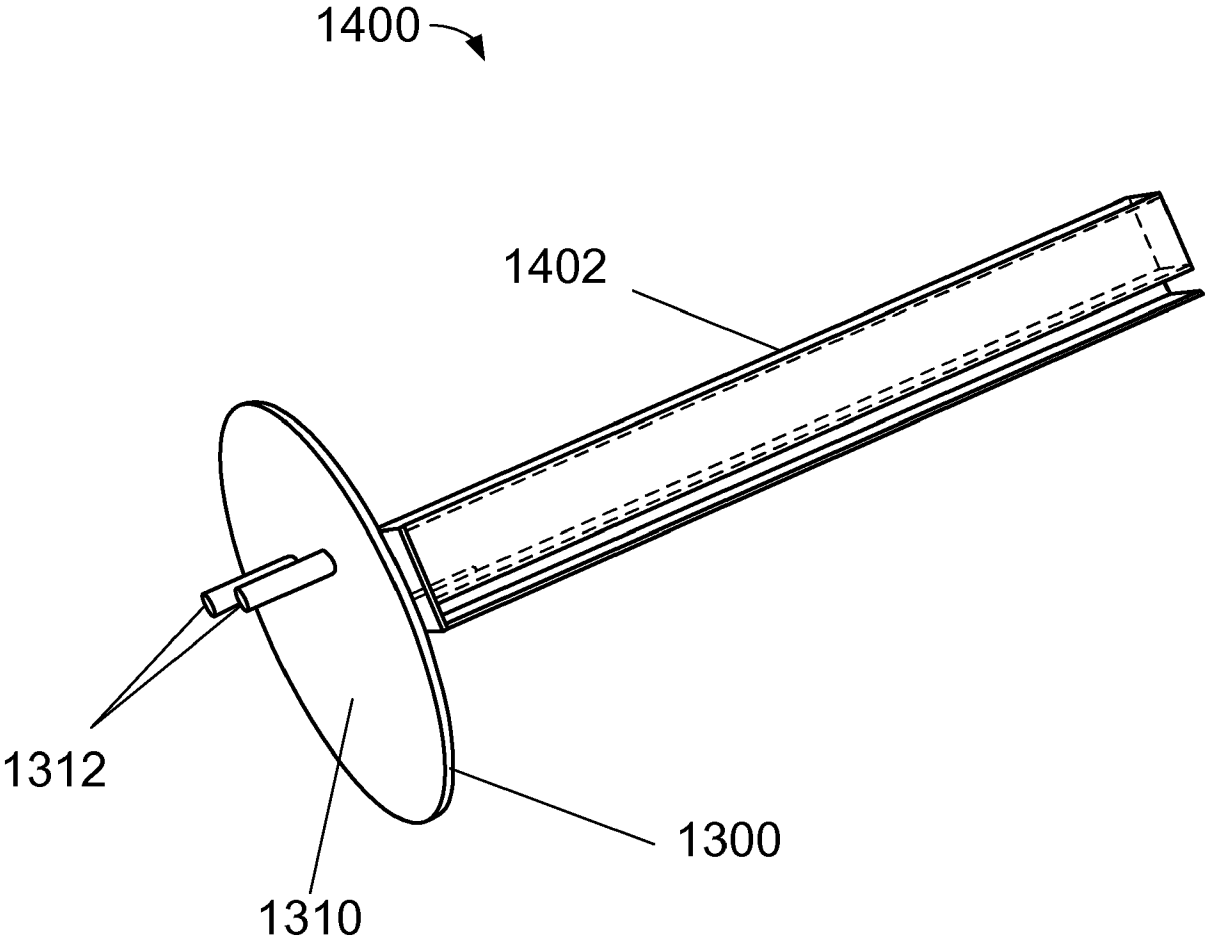
FIG. 14 illustrates an example spiraling surface antenna using a single half-wavelength antenna in combination with a circular microstrip quadrature hybrid from FIG. 13.

Previous discussions detailed fairly complex feeding techniques of λ/4 elements, requiring incorporating coaxial cables and/or microstrip transmission lines. The following discussion describes an example common aperture antenna design 700, 1100, or 1200 utilizing an approximately λ/2 element. The discussion will use the SSA 1200 as an example, but is also applicable to other designs, including the slotted cylinder antennas 700 and 1100. FIG. 14 illustrates an example embodiment of a λ/2 SSA 1402 and a circular QH 1300 combination. The QH 1300 may serve two purposes in this example: as a miniature ground plane and as a circular polarization generator.

Accordingly, in one embodiment a common aperture antenna 700, 1100, or 1200 may be constructed comprising two electrically conductive surfaces, for example 1200 and 1300, the first surface forming a first internal cavity and the second surface substantially forming a plane. In the embodiment, the first surface 1200 forms an opening configured to allow radio frequency (RF) energy access to the first internal cavity.

According to the embodiment, the first surface 1200 has a cross-sectional shape comprising at least one of a substantially circular shape, a substantially elliptical shape, a substantially spiraling shape, or a substantially polygonal shape. Additionally, an end of the first surface 1200 is positioned proximate to the second surface 1300, and the first surface is normal to the second surface, where the first surface and the second surface are separated by a predetermined distance.

The embodiment of further comprises a first electrically conductive feed, the first feed configured to induce a first electric field across the opening to energize a horizontal component of an omni-directional electromagnetic wave and a second electrically conductive feed, the second feed electrically coupled to the first surface 1200 and configured to induce a second electric field to energize a vertical component of the omni-directional electromagnetic wave. Additionally, at least one phase modulator is included to adjust a phase of one component of the omni-directional electromagnetic wave; and a pair of amplitude modulators are included to adjust the magnitude of the horizontal and vertical components of the omni-directional electromagnetic wave, wherein a vector sum of the horizontal and vertical components of the omni-directional electromagnetic wave is configurable to produce a desired gain and a desired polarization.

In an embodiment, the second surface 1300 may comprise a printed circuit 800, where the printed circuit 800 includes a number of conductors. For example, the conductors may be electrically coupled to the first surface 1200 an/or the second surface 1300.

FIG. 15 illustrates detail of an example feed junction of the SSA 1402. FIG. 15A illustrates a notch 1502 of an inside wall 1504 of the SSA 1402, to prevent shorting the center conductor 1506 of the horizontal polarization cable to the outer shield at the end cap 1508. Also shown is a clearance hole 1510 in the end cap so that the center conductor 1506 may extend through and be affixed to the inside wall 1504. FIG. 15B illustrates the feed configurations relative to the SSA 1402 and the example circular QH 1300.

FIG. 16 illustrates another configuration 1600 of the common aperture antenna 700 with an adjunct lower cylinder 1602 of identical or similar cross section dimension as an SSA 1604. In one example, a generally uniform cross section may be maintained throughout both elements 1602 and 1604. However, in other embodiments, the cross section of the adjunct 1602 can be larger or smaller, or of a different geometry than the cross section of the SSA 1604, as dictated by design requirements. FIGS. 16A, 16B and 16C illustrate the top view, side view and perspective view, respectively. In one example, as shown, the adjunct lower cylinder 1602 is hollow with a sealed end 1606 nearest the SSA 1604. The outer shield of the vertical polarization cable 1608 terminates and is affixed to this sealed end 1606. The center conductor 1610 continues through a clearance hole 1612 in the sealed end 1606, terminates at the end cap 1614 of the SSA, and is affixed to the end cap 1614. In one example, a horizontal polarization cable 1616 passes through a clearance hole 1618 in the sealed end 1606 of the adjunct lower cylinder 1602, and the outer shield terminates at the end cap 1614 of the SSA 1604 and is affixed to the end cap 1614. The center conductor 1620 passes through a clearance hole 1622 in the end cap 1614 then spans the mid wall-to-end cap spacing 1624 and is terminated and affixed to the mid wall 1626 inside surface. FIG. 16B shows an intentionally designed spacing 1624 between the end cap and the mid wall edge. In both FIGS. 16A and 16B the space between the SSA 1604 and the lower cylinder adjunct 1602 is shown to be air. In other embodiments, this space can be filled with dielectric.

In one embodiment, the entire unit 1600 may be placed in a radome for protection and structural robustness. If desired, the adjunct 1602 can be designed to be a RF choke to prevent current flow along the coaxial cables. In one example, the adjunct 1602 length can be shortened by filling the inside space of the adjunct 1602 with dielectric to maintain λ/4 RF choke electrical characteristics.

In one embodiment, the adjunct 1602 to the SSA 1604 can be made physically short and attached to a conducting sheet or ground plane. With this design, the SSA 1604 may convert into a dual polarization monopole over a ground plane, capable of multiple polarizations through amplitude and/or phase modulation. In other embodiments, the SSA 1604 can also be foreshortened to function as a resonator, with the adjunct 1602 having a conducting surface, so that the entire arrangement becomes a resonating antenna system.

Performance Characteristics

Figure 17:
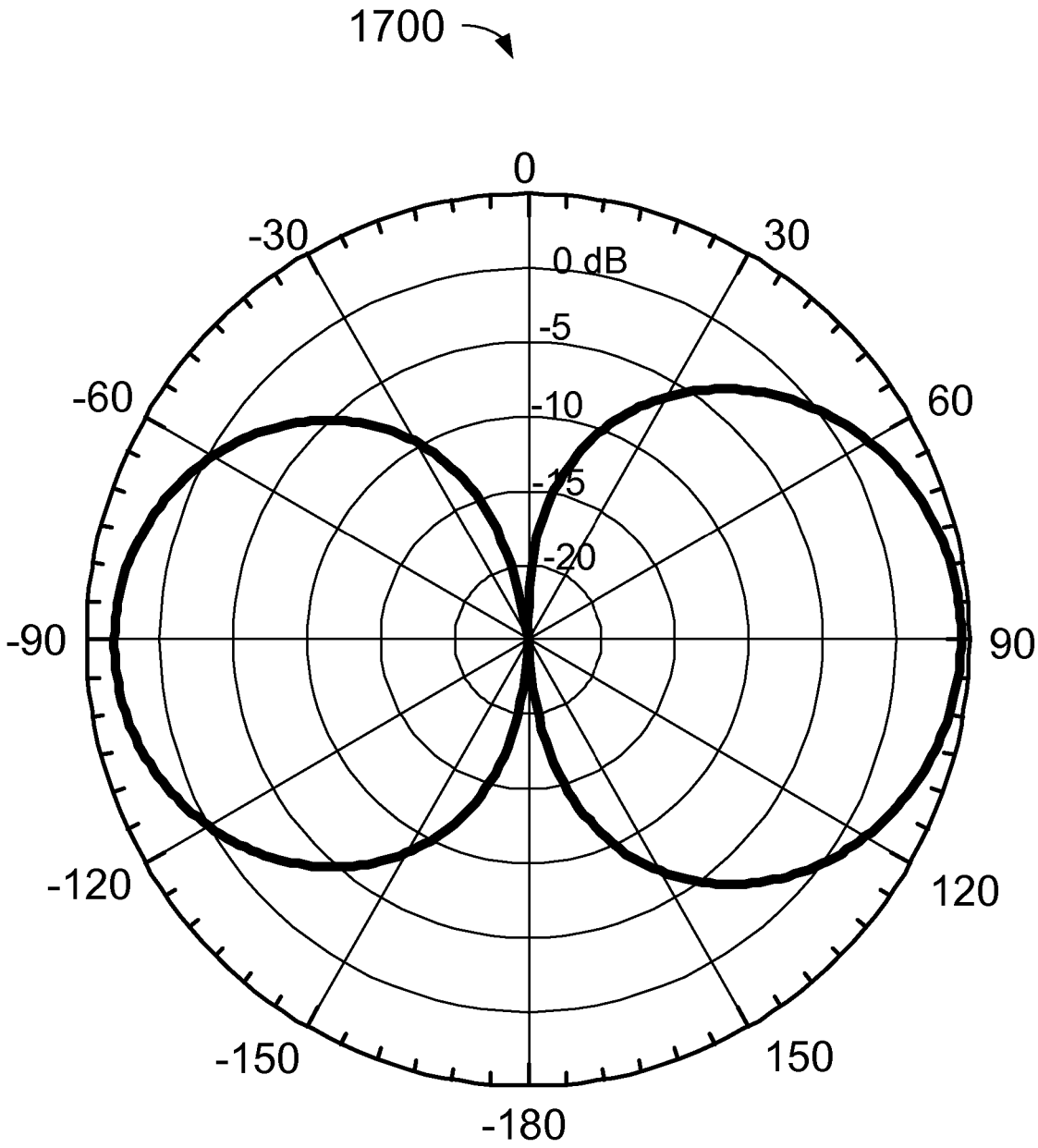
FIGS. 17 and 18 illustrate typical elevation patterns for horizontal and vertical polarizations, respectively, of an example dual polarized antenna.
Figure 18:
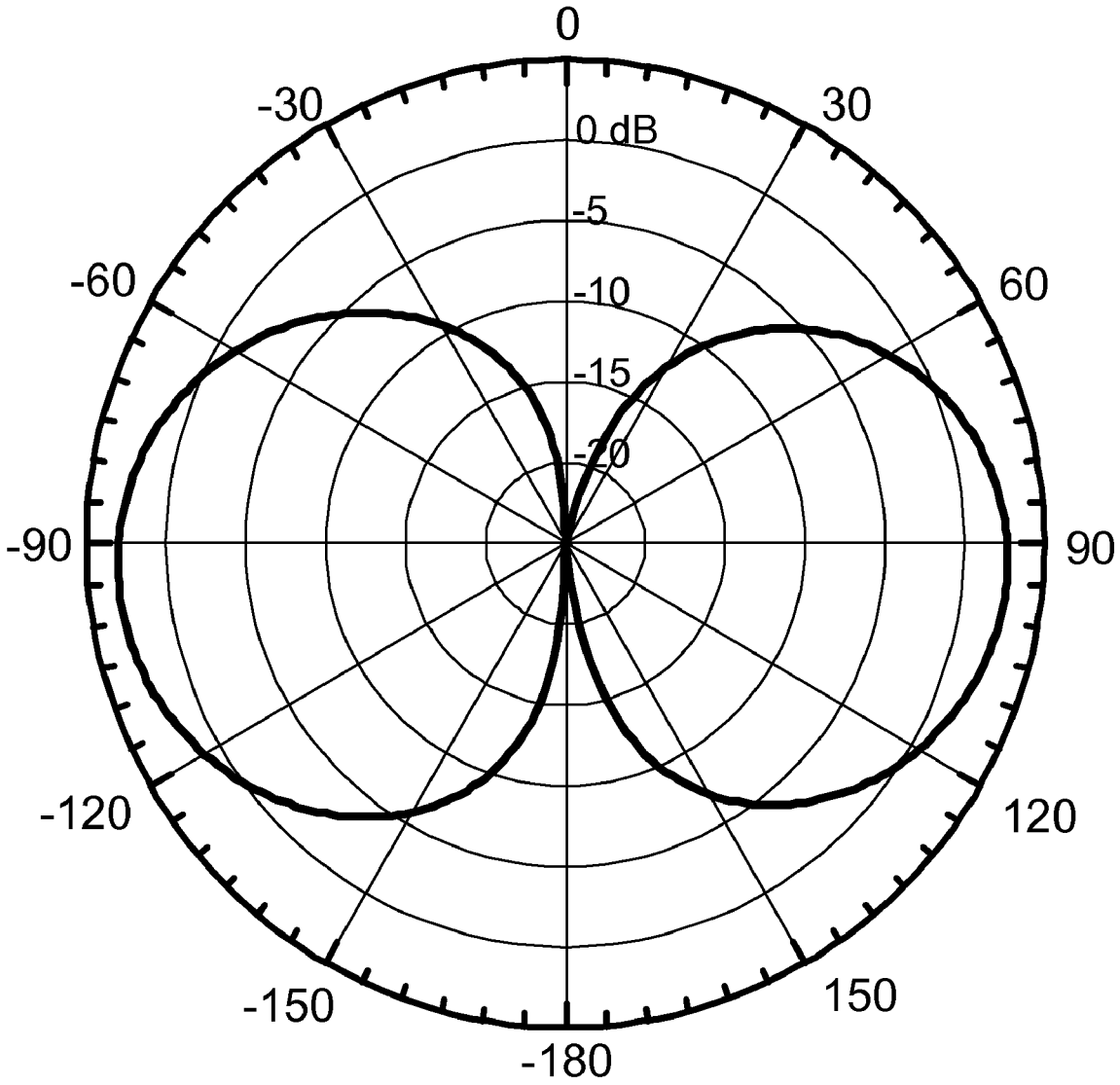
Figure 19:
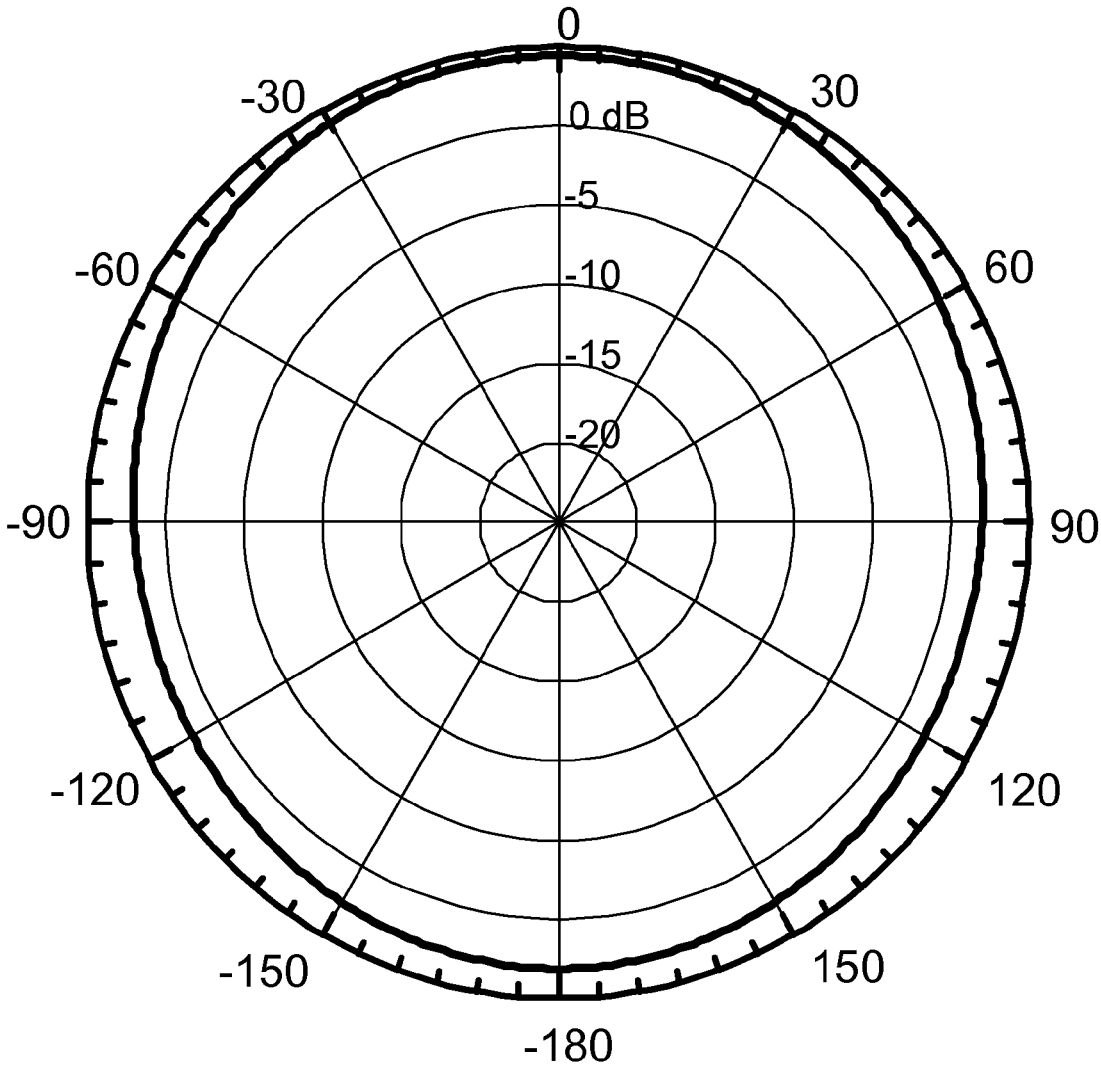
FIGS. 19 and 20 illustrate typical azimuth patterns for horizontal and vertical polarizations, respectively, of the example dual polarized antenna.
Figure 20:
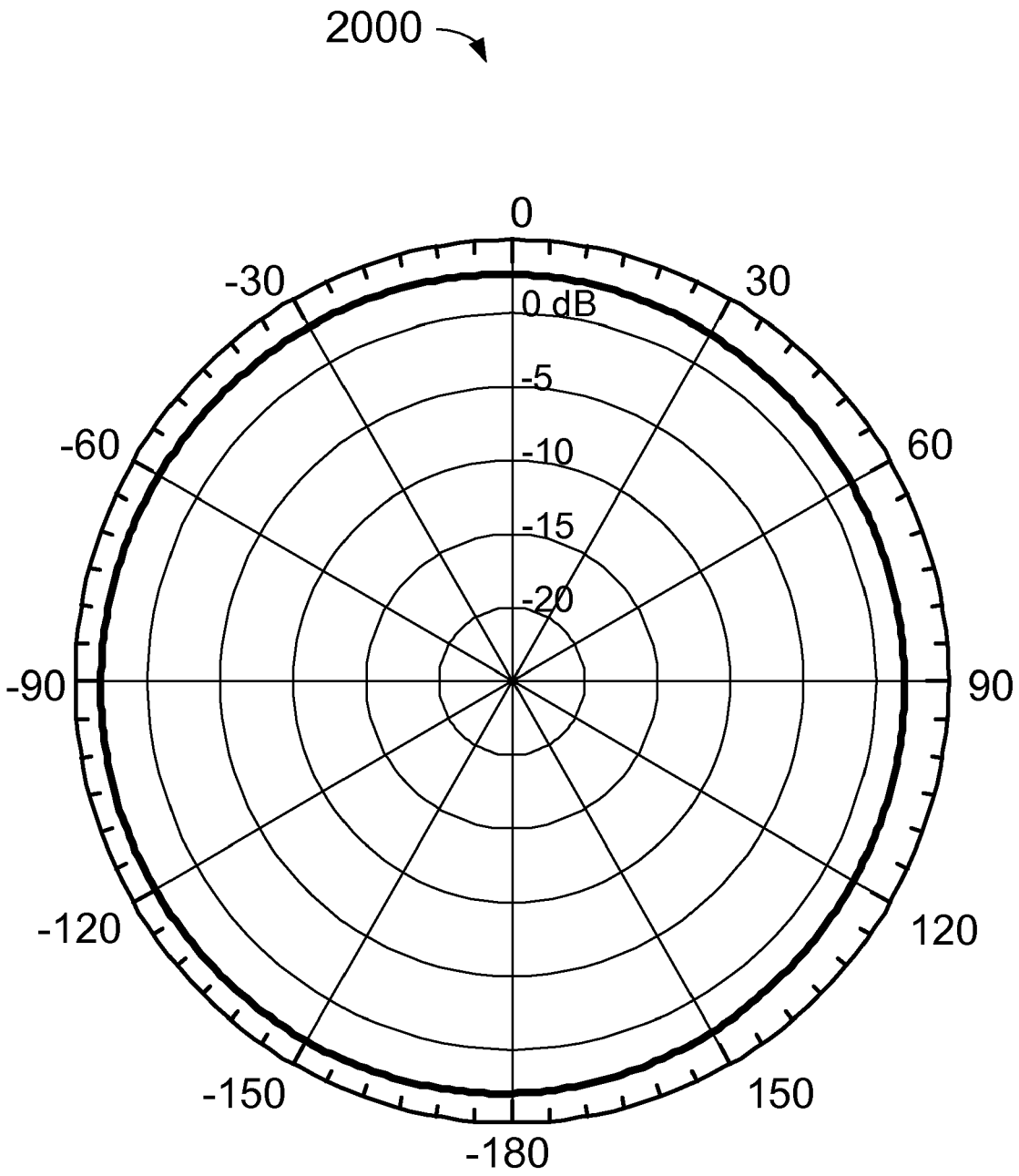

Example far field radiation patterns for both vertical and horizontal polarizations of antennas including 700, 1100, 1200, 1400, or 1600 are shown in FIGS. 17 through 20. FIG. 17 illustrates a horizontal polarization elevation pattern 1700 and FIG. 18 illustrates a vertical polarization elevation pattern 1800. Both pattern cross sections are generally figure-eight shaped (the vertical cross section of a toroid). FIG. 19 illustrates the azimuth horizontal polarization pattern 1900 and FIG. 20 illustrates the azimuth vertical polarization pattern 2000, where both are generally circular about the antenna axis, indicative of a omni-directional pattern. These patterns are very similar to those illustrated in FIGS. 5 and 6 discussed above.

Alternate Configurations

Figure 21:
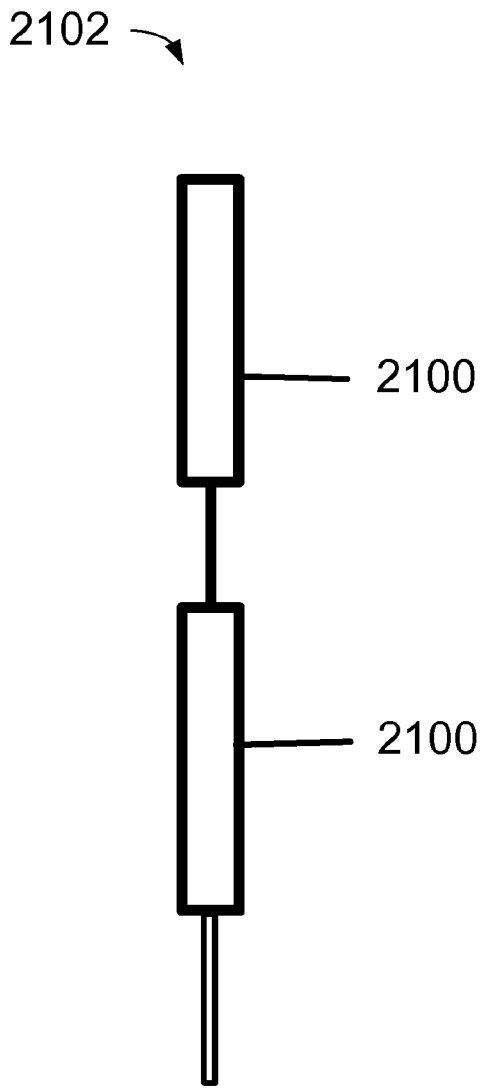
FIG. 21 illustrates an example of an array of antennas according to an embodiment.

As shown in FIG. 21, an antenna array may be constructed by stacking a number of collinearly-aligned D-pol constituent antennas 2100 (each constituent antenna being a complete elliptically-polarized D-pol antenna 700, 1100, 1200, 1400 or 1600), thus forming a column 2102. Each of the constituent antennas 2100 may have a transmission feed line associated with the constituent antenna 2100. A feed point associated with each antenna feed line may be spaced along the length of the column in such a way as to establish a desired phase relationship between each of the individual constituent antennas 2100 in the column. Forming a column of antennas 2100 may increase the effective aperture of the column with each antenna 2100 added. Thus, as the effective aperture of an antenna increases so does the gain of the antenna. For example, doubling the number of antennas 2100 in the array increases the gain by 3 dB.

Alternatively, rows containing columns 2102 of one or more antennas 2100 may be formed into an array. An array configured in this manner may be a planar array, or may be circular, elliptical, polygonal, or an array contoured to fit the shape of a structural surface. A desired phase relationship for each constituent antenna 2100 in such an array may be determined by design, taking into account the intended application of the antenna array. For example, such an array may be configured so that it produces high antenna gain in the direction of low power utility meters and simultaneously produces low antenna gain in the direction of interfering sources, such as cellular telephony networks or internet service providers.

An antenna 2100 (including 700, 1100, 1200, 1400, or 1600) may be designed to be relatively "slim," that is, it may have physical similarities to a dipole, but be a horizontally polarized omni-directional antenna. In a further embodiment, an antenna 2100 may also include a radome 2200 (shown in FIG. 22) that either partially or completely surrounds the antenna 2100. In an alternate embodiment, the radome 2200 may also partially or completely surround any supporting structure included with the antenna 2100. A radome 2200 is added to protect the antenna 2100 from damage or to provide an impedance match between the antenna 2100 and the propagation medium.

A radome 2200 may be a "structural" radome 2200 if it is intended to resist damage in outdoor applications. For example the radome 2200 may be constructed to survive mechanical loading experienced in high wind conditions or may be made of materials to resist corrosive atmospheres. Indoor environments may only require a simple non-structural coating on the antenna 2100 to resist snags and to provide a pleasing aesthetic form. In one example, a coating or similar covering on the antenna 2100 may be a "non-structural" radome 2200. In one embodiment, the radome 2200 is adapted to connect directly to an elevating member or a mounting structure for attachment purposes. In an exemplary embodiment, the radome 2200 may have a cross sectional shape (shown in FIG. 22B) configured to surround the antenna 2100 (and may also be configured to surround a supporting structure). The cross-sectional shape of the radome 2200 may be a substantially circular shape or a substantially elliptical shape or a substantially rectangular shape. The cross-sectional shape of the radome 2200 may also be constructed using combinations of the above shapes. Note that a polygonal shape may be approximated by one or a combination of a substantially circular shape or a substantially elliptical shape or a substantially rectangular shape. Further, since the antenna 2100 is slim, a defining smallest dimension of the cross-sectional shape (i.e., the diameter of a circle or minor axis of an ellipse or the shortest dimension of a rectangle) of a structural radome 2200 may be less than 0.2λ, or 0.2 times the wavelength of the center frequency of the antenna 2100. Further, since the antenna 2100 is slim, a defining smallest dimension of the cross-sectional shape (i.e., the diameter of a circle, minor axis of an ellipse, or the shortest dimension of a rectangle) of a non-structural radome 2200 may be less than 0.1λ, or 0.1 times the wavelength of the center frequency of the antenna 2100.

For example, a structural radome 2200 configured for an antenna 2100 designed around a center frequency of 915 MHz, may have a circular cross-section with a diameter of less than 2.5 inches and a non-structural radome configured for the same antenna 2100 may have a diameter of less than 1.3 inches. For another example, a structural radome 2200 configured for an antenna 2100 designed around a center frequency of 2437 MHz, may have an octagonal cross-section with a maximum dimension (the diagonal from one vertex to a directly opposite vertex) of less than 1 inch and a non-structural radome 2200 configured for the same antenna 2100 may have a maximum dimension of less than 0.5 inches.

In one embodiment, antenna 2100 may be partially or completely enveloped with a dielectric material. This process, referred to as dielectric loading, may include filling the internal cavities of the antenna 2100 with a dielectric material. Dielectric loading may allow all dimensions of the antenna 2100 to be reduced as a function of the wavelength of operation in the dielectric. This means that each physical dimension of an antenna 2100 that is designed to operate at a particular center frequency may be reduced in size by an equal ratio when dielectric loading is applied to the antenna 2100. For example, all physical dimensions of an antenna 2100 may be reduced by a factor of 0.53 if the antenna 2100 is dielectrically loaded utilizing a dielectric with a permittivity of 3.5. However, dielectric loading may affect the efficiency of an antenna 2100 based on the dissipation factor of the dielectric used. Dielectric loading may further reduce the slim cross-sections of radomes 2200 discussed previously by a corresponding factor based on the dielectric's permittivity. As mentioned above, an antenna 2100 designed around a frequency of 2437 MHz, with an air dielectric may include a structural radome 2200 with a maximum dimension of less than 1 inch. An antenna 2100 designed around the same frequency, but dielectrically loaded using a material with a permittivity of 3.5, may result in a structural radome 2200 having a maximum dimension of less than 0.53 inches.

Mechanical Considerations

Surfaces 704 and 706 to be used in constructing an elliptically-polarized dual-polarization antenna 2100 (including 700, 1100, 1200, 1400, or 1600) may be fabricated, for example, out of sheet metal, conductive coated plastic, flexible copper clad Mylar sheet, copper clad laminates, or any conductive material that can be made to hold physical dimensions and be robust enough to withstand expected environmental conditions. The surfaces 704 and 706 may be formed by rolling the surfaces 704 and 706 around a form, by extrusion, by machining, or other methods to produce the shape desired.

Commercially available materials including tubing, channels, and angle stock can be utilized to construct a surface 704 and 706 form factor. In one embodiment, a spiraling surface 1200 or 1402 may be constructed by assembling at least two formed parts. Formed parts may be formed by any suitable method including machining, extrusion, molding, bending and the like.

Sheet metal may also be used to construct a surface 704 and 706. Depending on the number of bends there are in the design, the sheet metal may be shaped into surfaces 704 and 706 using a brake, stamping, progressive dies or rolling.

Extruding metal can be a very cost-effective way of fabricating surfaces 704 and 706. Some advantages of this method include that the part may be extruded with all the required dimensions of surfaces 704 and 706. The extruded metal may be formed in long lengths, so that whatever length the design requires can simply be cut from the raw stock.

Surfaces 704 and 706 can also be fabricated from etched copper-clad substrates (printed circuits). One advantage of this method is the tight tolerances that can result from the etching process. Etched copper-clad boards may have tabs and notches fabricated into them, so that each printed circuit is held accurately in place during assembly. The use of copper cladding is an example only, and other conductive cladding (such as gold, silver, aluminum, and the like) may also be used on substrates for this purpose.

In one embodiment, etched boards may be coupled together to form surfaces 704 and 706. In alternate embodiments, one or more of the walls may be omitted to form the surfaces 704 and 706. In further alternate embodiments, one or more additional walls may be added to form the surfaces 704 and 706.

Plastics can be molded or extruded into surfaces 704 and 706. The walls of a plastic surface, however, must be selectively coated with conductive material for use as an antenna.

For example, flexible copper-clad Mylar is ideal for imbedding within a dielectric material. A feed line and the structure of surfaces 704 and 706 can be etched on the Mylar sheet. The sheet may then be wrapped around a form, and the entire assembly may be over molded with dielectric material, becoming a solid structure in the form of surfaces 704 and 706.

Conclusion

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

Additionally, while various discreet embodiments have been described throughout, the individual features of the various embodiments may be combined to form other embodiments not specifically described. The embodiments formed by combining the features of described embodiments are also spiral surface antennas.

The invention claimed is:

1. An antenna comprising:

a first electrically conductive surface and a second electrically conductive surface, the first surface forming a first internal cavity and the second surface forming a second internal cavity, the first surface forming a first opening configured to allow radio frequency (RF) energy access to the first internal cavity, wherein the first surface is positioned proximate to the second surface, the first surface and the second surface being collinearly aligned, the first surface and the second surface being separated by a predetermined distance; and a structural member comprising a printed circuit, the structural member coupled to the first surface and the second surface, the structural member supporting the first surface and the second surface, the printed circuit comprising a plurality of conductors electrically coupled to the first surface and the second surface.

2. The antenna as recited in claim 1, the printed circuit comprising a first electrically conductive feed configured to induce a first electric field across the first opening to energize a horizontal component of an electromagnetic wave, and a second electrically conductive feed electrically coupled to the first surface and configured to induce a second electric field across the first and second surfaces to energize a vertical component of the electromagnetic wave.

3. The antenna as recited in claim 1, wherein the first surface has a cross-sectional shape comprising at least one of a substantially circular shape, a substantially elliptical shape, a substantially spiraling shape, or a substantially polygonal shape; and wherein the second surface has a cross-sectional shape comprising at least one of a substantially circular shape, a substantially elliptical shape, a substantially spiraling shape, or a substantially polygonal shape.

4. The antenna as recited in claim 1, wherein the first surface is electrically coupled to the second surface.

5. The antenna as recited in claim 1, wherein the conductors comprise a first distribution member electrically coupled to the first surface to distribute electrical energy to substantially evenly energize the first surface, and a second distribution member electrically coupled to the second surface to distribute electrical energy to substantially evenly energize the second surface.

6. The antenna as recited in claim 5, wherein the first distribution member and the second distribution member are substantially planar, are coplanar, and are separated by a predetermined gap.

7. The antenna as recited in claim 1, wherein the printed circuit comprises:

a first layer comprising a first electrical conductor, the first electrical conductor configured to energize a horizontal component of an electromagnetic wave;

a second layer comprising a dielectric material;

a third layer comprising a second electrical conductor, the second electrical conductor configured as a ground for the first and third electrical conductors, the second electrical conductor being electrically coupled to the first surface or the second surface;

a fourth layer comprising a dielectric material;

a fifth layer comprising a third electrical conductor, the third electrical conductor configured to energize a vertical component of the electromagnetic wave;

a sixth layer comprising a dielectric material; and a seventh layer comprising a fourth electrical conductor, the fourth electrical conductor configured as a ground for the third electrical conductor, the fourth electrical conductor being electrically coupled to the first surface and the second surface.

8. The antenna as recited in claim 1, wherein the first surface and the second surface are configured to form a dipole, the dipole configured to produce a first omni-directional electromagnetic wave, the first electromagnetic wave being linearly-polarized, and wherein the first opening and a second opening in the second surface are configured to produce a second omni-directional electromagnetic wave, the second electromagnetic wave being orthogonally-polarized relative to the first electromagnetic wave.

9. The antenna as recited in claim 1, further comprising:

a first phase modulator configured to adjust a phase of a first signal being carried on at least one of the plurality of conductors;

a first amplitude modulator configured to adjust a magnitude of the first signal; and a second amplitude modulator configured to adjust a magnitude of a second signal being carried on at least one other of the plurality of conductors, wherein a vector sum of the first signal and the second signal is configurable to produce a desired gain and a desired polarization.

10. The antenna as recited in claim 1, wherein the first surface and the second surface each have two ends, and wherein at least one end of the first surface and/or at least one end of the second surface is electrically coupled to an electrically conductive end cap.

11. The antenna as recited in claim 1, wherein a length of the antenna is responsive to a wavelength of a wireless signal to be transceived by the antenna, the antenna further comprising a radome that at least partially surrounds the antenna, the radome having a cross-sectional shape, the cross-sectional shape being a substantially circular shape, or a substantially elliptical shape, or a substantially rectangular shape, wherein the radome is a structural radome, and wherein a smallest dimension of the cross-sectional shape of the structural radome is less than 0.2 times the wavelength of the wireless signal being transceived by the antenna.

12. The antenna as recited in claim 1, wherein a length of the antenna is responsive to a wavelength of a wireless signal to be transceived by the antenna, the antenna further comprising a radome that at least partially surrounds the antenna, the radome having a cross-sectional shape, the cross-sectional shape being a substantially circular shape, or a substantially elliptical shape, or a substantially rectangular shape, wherein the radome is a non-structural radome, and wherein a smallest dimension of the cross-sectional shape of the non-structural radome is less than 0.1 times the wavelength of the wireless signal being tranceived by the antenna.

13. An array comprising a plurality of the antennas as recited in claim 1.

14. The antenna as recited in claim 1, wherein the printed circuit is located partially within the first internal cavity and partially within the second internal cavity, the printed circuit further configured to provide structural support to the first surface and the second surface.

15. The antenna as recited in claim 1, wherein the first surface and the second surface are unequal in length and wherein a shorter of the first and second surfaces includes an end cap sealed at an end proximal to the longer of the surfaces, and the shorter surface is configured to act as an RF choke for the antenna.

16. An antenna comprising:

a first electrically conductive surface and a second electrically conductive surface, the first surface forming a first internal cavity and the second surface substantially forming a plane, the first surface forming an opening configured to allow radio frequency (RF) energy access to the first internal cavity, wherein the first surface has a cross-sectional shape comprises at least one of a substantially circular shape, a substantially elliptical shape, a substantially spiraling shape, or a substantially polygonal shape, and wherein an end of the first surface is positioned proximate to the second surface, the first surface being normal to the second surface, the first surface and the second surface being separated by a predetermined distance;

a first electrically conductive feed, the first electrically conductive feed configured to induce a first electric field across the opening to energize a horizontal component of an omni-directional electromagnetic wave;

a second electrically conductive feed, the second electrically conductive feed electrically coupled to the first surface and configured to induce a second electric field to energize a vertical component of the omni-directional electromagnetic wave; and a first phase modulator to adjust a phase of one of the vertical or horizontal components of the omni-directional electromagnetic wave;

a first amplitude modulator configured to adjust a magnitude of the horizontal component of the omni-directional electromagnetic wave; and a second amplitude modulator to adjust a magnitude of the vertical component of the omni-directional electromagnetic wave, wherein a vector sum of the horizontal and vertical components of the omni-directional electromagnetic wave is configurable to produce a desired gain and a desired polarization.

17. The antenna as recited in claim 16, wherein a length of the antenna is set responsive to a wavelength of a wireless signal to be transceived by the antenna, the antenna further comprising a radome that at least partially surrounds the antenna, the radome having a cross-sectional shape, the cross-sectional shape being a substantially circular shape, or a substantially elliptical shape, or a substantially rectangular shape, wherein when the radome comprises:

a structural radome, a smallest dimension of the cross-sectional shape of the structural radome is less than 0.2 times the wavelength of the wireless signal being transceived by the antenna, or a non-structural radome, the smallest dimension of the cross-sectional shape of the non-structural radome is less than 0.1 times the wavelength of the wireless signal being transceived by the antenna.

18. An array comprising a plurality of the antennas as recited in claim 16.

19. The antenna as recited in claim 16, wherein the second surface comprises a printed circuit, the printed circuit comprising a plurality of conductors electrically coupled to the first surface and the second surface.

* * * * *